US009562419B2

(12) United States Patent
Fleckenstein et al.

(10) Patent No.: US 9,562,419 B2
(45) Date of Patent: Feb. 7, 2017

(54) DOWNHOLE TOOLS AND METHODS FOR SELECTIVELY ACCESSING A TUBULAR ANNULUS OF A WELLBORE

(71) Applicant: Colorado School of Mines, Golden, CO (US)

(72) Inventors: William Winfrid Fleckenstein, Lakewood, CO (US); Todd Lance Flaska, Louisville, CO (US)

(73) Assignee: Colorado School of Mines, Golden, CO (US)

( * ) Notice: Subject to any disclaimer, the term of this patent is extended or adjusted under 35 U.S.C. 154(b) by 642 days.

(21) Appl. No.: 14/055,206

(22) Filed: Oct. 16, 2013

(65) Prior Publication Data

US 2014/0041876 A1 Feb. 13, 2014

Related U.S. Application Data

(63) Continuation-in-part of application No. 13/267,691, filed on Oct. 6, 2011, now Pat. No. 8,991,505.

(60) Provisional application No. 61/390,354, filed on Oct. 6, 2010.

(51) Int. Cl.

| | |
|---|---|
| ***E21B 34/08*** | (2006.01) |
| ***E21B 34/06*** | (2006.01) |
| ***E21B 43/16*** | (2006.01) |
| ***E21B 34/14*** | (2006.01) |
| ***E21B 43/14*** | (2006.01) |

(Continued)

(52) U.S. Cl.

CPC ..... *E21B 34/08* (2013.01); *E21B 34/063* (2013.01); *E21B 34/14* (2013.01); *E21B 43/14* (2013.01); *E21B 43/16* (2013.01); *E21B 43/26* (2013.01); *E21B 2034/005* (2013.01); *E21B 2034/007* (2013.01)

(58) Field of Classification Search

CPC ..... E21B 2034/005; E21B 2034/007; E21B 34/08; E21B 34/10; E21B 34/14; E21B 43/25; E21B 43/14; E21B 43/26

USPC ..... 166/318, 332.8, 332.4, 334.4, 383, 373, 166/305.1, 195

See application file for complete search history.

(56) References Cited

U.S. PATENT DOCUMENTS

| | | | |
|---|---|---|---|
| 3,211,232 | A | 10/1965 | Grimmer |
| 3,955,634 | A | 5/1976 | Slator et al. |
| 4,099,563 | A | 7/1978 | Hutchison et al. |

(Continued)

FOREIGN PATENT DOCUMENTS

| | | |
|---|---|---|
| GB | 890144 | 2/1965 |
| WO | WO 2011/146866 | 11/2011 |

OTHER PUBLICATIONS

Arispe, M. et al., "Utilizing Modern Frac Baffles Improves Completion Efficiencies," SPE 116232, Sep. 21-24, 2008, 13 pages, Society of Petroleum Engineers Inc., Texas, USA.

(Continued)

*Primary Examiner* — George Gray
(74) *Attorney, Agent, or Firm* — Sheridan Ross P.C.

(57) ABSTRACT

A downhole tool that selectively opens and closes an axial/lateral bore of a tubular string positioned in a wellbore used to produce hydrocarbons or other fluids. When integrated into a tubular string, the downhole tool allows individual producing zones within a wellbore to be isolated between stimulation stages while simultaneously allowing a selected formation to be accessed. The downhole tools and methods (Continued)

can be used in vertical or directional wells, and additionally in cased or open-hole wellbores.

20 Claims, 24 Drawing Sheets

(51) Int. Cl.
*E21B 43/26* (2006.01)
*E21B 34/00* (2006.01)

(56) References Cited

U.S. PATENT DOCUMENTS

| | | | |
|---|---|---|---|
| 4,292,988 | A | 10/1981 | Montgomery |
| 4,437,522 | A | 3/1984 | Krause, Jr. et al. |
| 4,469,174 | A | 9/1984 | Freeman |
| 4,510,994 | A | 4/1985 | Pringle |
| 4,711,305 | A | 12/1987 | Ringgenberg |
| 4,729,432 | A | 3/1988 | Helms |
| 4,823,882 | A | 4/1989 | Stokley et al. |
| 4,828,037 | A | 5/1989 | Lindsey et al. |
| 4,862,966 | A | 9/1989 | Lindsey et al. |
| 4,893,678 | A | 1/1990 | Stokley et al. |
| 5,090,481 | A | 2/1992 | Pleasants et al. |
| 5,146,992 | A | 9/1992 | Baugh |
| 5,244,044 | A | 9/1993 | Henderson |
| 5,392,862 | A | 2/1995 | Swearingen |
| 5,727,641 | A | 3/1998 | Eddison et al. |
| 5,803,178 | A | 9/1998 | Cain |
| 6,068,642 | A | 5/2000 | Johnson et al. |
| 6,290,004 | B1 | 9/2001 | Evans |
| 6,394,184 | B2 | 5/2002 | Tolman et al. |
| 6,675,909 | B1 | 1/2004 | Cowart et al. |
| 6,966,368 | B2 | 11/2005 | Farquhar |
| 7,225,887 | B2 | 6/2007 | Kriesels |
| 7,267,172 | B2 | 9/2007 | Hofman |
| 7,287,596 | B2 | 10/2007 | Frazier et al. |
| 7,322,417 | B2 | 1/2008 | Rytlewski et al. |
| 7,325,616 | B2 | 2/2008 | Lopez de Cardenas et al. |
| 7,373,974 | B2 | 5/2008 | Connell et al. |
| 7,377,321 | B2 | 5/2008 | Rytlewski |
| 7,387,165 | B2 | 6/2008 | Lopez de Cardenas et al. |
| 7,798,229 | B2 | 9/2010 | Vick, Jr. et al. |
| 7,891,442 | B2 | 2/2011 | Orban |
| 7,926,571 | B2 | 4/2011 | Hofman |
| 2007/0272411 | A1 | 11/2007 | Lopez de Cardenas et al. |
| 2007/0272413 | A1 | 11/2007 | Rytlewski et al. |
| 2009/0056934 | A1* | 3/2009 | Xu ..... E21B 43/26 166/244.1 |
| 2009/0065194 | A1 | 3/2009 | Frazier |
| 2009/0084553 | A1 | 4/2009 | Rytlewski et al. |
| 2010/0294510 | A1 | 11/2010 | Holmes |
| 2011/0056692 | A1 | 3/2011 | Lopez de Cardenas et al. |
| 2011/0073321 | A1* | 3/2011 | Fay ..... E21B 23/04 166/373 |
| 2011/0132621 | A1 | 6/2011 | Agrawal et al. |
| 2011/0284232 | A1 | 11/2011 | Huang |
| 2012/0061088 | A1 | 3/2012 | Dykstra et al. |
| 2012/0085548 | A1* | 4/2012 | Fleckenstein ..... E21B 34/063 166/373 |

OTHER PUBLICATIONS

Bracken, L., "How to Destroy the Earth's Fresh Water Supplies Without Anyone Finding Out," 2007-2009, 30 pages, available at http://www.journeyoftheforsaken.com/fracpage.htm.
"Cobra Frac® H Service Enables High-Intensity Multistage Fracturing and Post-Frac Analysis," Halliburton, Oct. 2009, 2 pages.
Conductor Pipe_PGL00003 webshot, as late as Jun. 18, 2010, 1 page, available at http://www.glossary.oilfield.slb.com/files/OGL00003.gif.
Cook Inlet Wellbore Schematic, Figure 5.2, Final Finding of the Director Cook Inlet Areawide 1999 Oil and Gas Lease Sale Jan. 20, 1999, Chapter 5, p. 5-42, Oct. 17, 1999, available at http://dog.dnr.alaska.gov/Publications/CookInlet.htm.
"Delta Stim® Initiator Valve," Halliburton, 2010, 4 pages.
"Delta Stim® Lite Sleeve," Halliburton, 2009, 2 pages.
"Delta Stim® Plus 20 Completion Service," Halliburton, 2010, 4 pages.
"Excape Completion Process," Expro Int'l Group Ltd., 2010, 1 page, available at http://exprogroup.com/products-services/well-testing-commissioning/well-test/excape/.
"Excape$^{SM}$ Completion Process: Your Fastest Path to Profit," BJ Services, The Expro Group & Marathon Oil Co., 2004, 5 pages.
"Extending the Productive Life of Mature Assets," Halliburton, 2007, pp. 1-48.
Freudenrich, C., "How Oil Drilling Works," printed on Jun. 18, 2010, 3 pages, available at http://science.howstuffworks.com/oil-drilling4.htm.
Granberg, A., "Hydraulic Fracturing," 2010, 1 page, available at http://oecotextiles.files.wordpress.com/2010/02/hydraulic-fracturing.jpg.
Hejl, K.A. et al., "Extreme Multistage Fracturing Improves Vertical Coverage and Well Performance in the Lost Hills Field," SPE 101840, Sep. 24-27, 2006, 9 pages, Society of Petroleum Engineers Inc., Texas, USA.
"Horizontal Well Stimulation," Williston Basin Petroleum Conference, Halliburton, May 1, 2007, 24 pages.
Lonnes, S.B. et al., "Advanced Multizone Stimulation Technology," SPE 95778, Oct. 9-12, 2005, pp. 1-7, Society of Petroleum Engineers Inc., Texas, USA.
"Magnum Stimulation Valve" product brochure, Magnum Oil Tools Int'l, Corpus Christi, TX, Dec. 2, 2009, 1 page.
"New Methods Boost Multistage Fracturing in Horizontals," J. Petroleum Technology, vol. 59, No. 7, Jul. 2007, 3 pages.
"OptiFrac™ SJ Multizone Fracturing Process," BJ Services, Aug. 2009, 2 pages.
"Packers Plus® StageFRAC™" brochure, Oct. 1, 2009, 2 pages.
"Pump Jack," Wikipedia, Aug. 3, 2008, 1 page, available at http://en.wikipedia.org/wiki/File:Pump_Jack_labelled.png.
"QuickFRAC" brochure, Packers Plus Energy Services, Mar. 22, 2011, 4 pages, available at http://www.packersplus.com/products/quickfrac.php.
"QuickFRAC Batch Fracturing System Overview" Packers Plus Energy Services, Mar. 22, 2011, 1 page, available at http://www.packersplus.com/products/quickfrac.php.
"RapidFrac System," Halliburton, Jul. 26, 2011, 6 pages, available at http://www.halliburton.com/ps/default.aspx?pageid=5313&prodid=PRN::LK0BSD15.
"RapidFrac™ System for Use with Multi-Point Completions and Sub-Inteval Fracturing," Halliburton, Aug. 5, 2011, 3 pages.
"RepeaterPORT" brochure, Packers Plus Energy Services, Aug. 3, 2011, 2 pages, available at http://packersplus.com/products/repeaterport.php.
"RepeaterPort" Case Study, Packers Plus Energy Services, Aug. 3, 2011, 1 page, available at http://packersplus.com/products/repeaterport.php.
"RepeaterPORT Sleeve" Overview, Packers Plus Energy Services, Aug. 19, 2011, 1 page, available at http://packersplus.com/products/repeaterport.php.
"StackFRAC HD: High Density Multi-Stage Fracturing System Overview," Packers Plus Energy Services, Feb. 9, 2011, 6 pages, available at http://www.packersplus.com/products/stackfrac.php.
"StageFRAC," Schlumberg, 2007, 2 pages.
International Search Report for International (PCT) Application No. PCT/US11/55151, mailed Feb. 27, 2012.
Written Opinion for International (PCT) Application No. PCT/US11/55151, mailed Feb. 27, 2012.
International Preliminary Report on Patentability for International (PCT) Patent Application No. PCT/US2011/055151, mailed Apr. 18, 2013 7 pages.
Official Action for U.S. Appl. No. 13/267,691 mailed Apr. 10, 2014, 5 pages.
Official Action for U.S. Appl. No. 13/267,691 mailed Aug. 1, 2014, 13 pages.
Notice of Allowance for U.S. Appl. No. 13/267,691 mailed Nov. 26, 2014, 8 pages.

* cited by examiner

SECTION A-A

DETAIL A

DETAIL A

DOWNHOLE TOOLS AND METHODS FOR SELECTIVELY ACCESSING A TUBULAR ANNULUS OF A WELLBORE

CROSS REFERENCE TO RELATED APPLICATION

This application is a continuation-in-part of U.S. patent application Ser. No. 13/267,691, filed Oct. 6, 2011, which claims the benefit of U.S. Provisional Application No. 61/390,354, filed Oct. 6, 2010, the entire disclosures of which are hereby incorporated herein by reference in their entirety.

FIELD OF THE INVENTION

Embodiments of the present invention are generally related to selectively opening and closing one or more ports or access openings in a tubular string. More specifically, one embodiment allows selective access of a tubular annulus of a wellbore to provide a flow path between a tubular string positioned in the wellbore and a geologic formation that requires a treatment such as hydraulic fracturing.

BACKGROUND OF THE INVENTION

A wellbore used in recovering oil/gas typically includes a production string placed within a casing string. In some wellbore designs, the entire length of the wellbore is lined with the casing string, which is cemented within the wellbore. Alternatively, in open-hole designs, the casing string is limited to an upper portion of the wellbore and lower portions of the wellbore are open. In both open-hole and cased-hole designs, the production string is typically placed into the lower portions of the wellbore and mechanical or hydraulic packers are used to radially secure the production string in a predetermined location. The outside diameter of the production tubing is less than the diameter of the internal wellbore or production casing, thereby defining a tubular annulus.

To gain access to oil/gas deposits in the general area of the wellbore, selected portions of the production casing are perforated or, alternatively, sliding sleeves or other devices are used to provide a conduit to the oil and gas deposits. To enhance the flow of oil/gas into the tubular annulus, and to thus increase flow into the production tubing, hydraulic fracturing (i.e., "fracing") of subterranean formations may be required, especially in low permeability formations. That is, in some instances subterranean formation that the wellbore penetrates does not possess sufficient permeability for the economic production of oil/gas so hydraulic fracturing and/or chemical stimulation of the subterranean formation is needed to increase flow performance.

Hydraulic fracturing consists of selectively injecting fracturing fluids into a subterranean formation in openhole or via perforations or other openings in the production casing of the wellbore at high pressures and rates to form a fracture. In addition, granular proppant materials, such as sand, ceramic beads, or other materials are injected into the formation with the fracturing fluids to hold the fracture open after the hydraulic pressure has been released. The proppant material prevents the fracture from closing and thus provides a more permeable flow path within the subterranean formation, resulting in increased flow capacity. In chemical stimulation treatments, permeability and thus flow capacity is improved by dissolving materials in the formation or otherwise chemically changing formation properties.

To gain access to multiple or layered reservoirs, or a very thick hydrocarbon-bearing formation by hydraulic fracturing, multiple fracturing zones are established and stimulated in stages. One technique currently being used with significant results utilizes the use of a directionally drilled well into a single reservoir. By drilling the well in a substantially horizontal orientation through the reservoir, the reservoir can be fractured in multiple locations to substantially improve the flow rate. To stimulate multiple fracturing zones, a target stimulation zone must be temporarily isolated from the already-stimulated zones to prevent injecting fluids into the already-stimulated zones. Various methods have been utilized to achieve zonal isolation, although numerous drawbacks to the current methods exist.

A common method currently used to isolate a fracturing zone in multistage fracturing utilizes composite bridge plugs. According to this method, the deepest zone in the wellbore (or most distal in horizontal wellbores) is stimulated. Then, the stimulated zone is isolated by a bridge plug that is positioned above the perforations associated with the stimulated zone. The process is repeated in the next zone up the wellbore. At the end of the stimulation process, a wellbore clean-out operation removes the bridge plug. The major disadvantages of using one or more bridge plugs to isolate a fracture stimulated zone are the high cost and risk of complications associated with multiple trips into and out of the wellbore to position the plugs. For example, bridge plugs can become stuck in the wellbore and need to be drilled out at great expense. A further disadvantage is that the required wellbore cleanout operation may block or otherwise damage some of the successfully fractured zones.

Another method used to isolate a fracturing zone utilizes frac baffles and balls. The first baffle, which contains the smallest inside diameter, is placed in the most distal portion of the wellbore. The succeeding baffles increase in diameter and are installed above the previous baffle. To achieve zonal isolation, a frac ball of a predetermined size is dropped that seats on the corresponding frac baffle at a specified depth or position to block a portion of the wellbore. The isolated zone is accessed by perforations or a sleeve is shifted then stimulated. After each stage, the process is repeated until all selected frac zones in the well are fracture stimulated. On the last day of operation, the frac balls typically are flowed back to the surface during the flow back of the fracturing fluids. The primary advantage of this method is that the frac baffles are installed within the casing and can be activated by dropping a ball from the surface, with little downtime between fracture stimulation stages. The disadvantages include the need to use progressively larger sized balls for subsequent fracturing stages, thus limiting the number of zones that can be treated for a given casing diameter. Additionally, the frac baffles and balls may need to be milled out of the casing string, which increases the number of wellbore operations and inherent risks and costs associated therewith.

One method for successfully isolating one or more production zones utilizes a sliding sleeve that is associated with a tubular string, which may include casing, liners, tubing, etc. Opening the sleeve permits zonal isolation and stimulation of the formation via the tubular string through the selected sleeve. The sleeve can be operated by using a mechanical/hydraulic shifting tool attached to coiled or jointed tubular or by using a ball-drop system. In a ball-drop system, a ball pumped down the tubular string engages a sliding sleeve and shifts the sleeve from a closed position to an open position, thereby opening a passageway to the tubular annulus. The ball also isolates the already-stimulated zones located beneath the open sleeve. The advantages of this method are that the tubular annulus can be accessed without requiring various tools or costly trips into the wellbore to isolate the various formations. However, the method is limited by the need to use progressively larger sized balls for subsequent fracturing stages, thus limiting the number of zones that can be deployed for a given tubing string diameter. This system inherently restricts the production flow rate due to the necessity of using progressively smaller balls to open and close the sleeves.

Accordingly, a need exists for an improved downhole tools and methods that efficiently isolates individual zones of a subterranean formation while (1) ensuring that stimulation fluids are directed to the desired location, (2) maintaining a desired inner diameter of the tubing string, (3) reducing the time between stimulations, and (4) is mechanically simplistic to operate and cost effective.

The following disclosure describes improved downhole tools and methods for selectively isolating downstream portions of a tubular string while simultaneously allowing access to the tubular annulus of a wellbore such that a selected zone may be stimulated. The improved downhole tools and methods do not limit the number of fracture stimulation stages created in a vertical or directional wellbore. As used herein, 'downstream' and 'lower' refers to the distal portions of a tubular string disposed toward the toe of the wellbore. Further, as used herein, 'treatment fluid' may comprise acid, proppant material, gels, or other stimulation fluids generally used in the art.

SUMMARY OF THE INVENTION

The downhole tools disclosed herein is designed for downhole well stimulation for oil and gas wells, but could be used for any downhole application where a shifting sleeve is used to selectively divert flow. Additionally, the downhole tools may be employed in either open or cased holes. Generally, a downhole tool is placed into a wellbore and provides for the opening of the tubular string to the geologic formation while simultaneously restricting the flow of fluid and proppant downstream of the downhole tool. Fluid with or without proppant is then pumped into the geologic formation through the openings to stimulate the rock through hydraulic fracturing (fracing) or other treatment processes. By progressing from the toe (bottom) of the well back toward the surface, it is possible to stimulate the subterranean formation in stages, thus improving the quality of the stimulation and/or minimizing fluid/proppant. The downhole tools disclosed herein improve upon existing shifting sleeve designs by 1) allowing for a very large number of stimulation stages (50-200), 2) minimizing the flow restrictions inherent in ball drop systems that rely on progressively smaller ball diameters, 3) providing a system that does not need to be drilled out in order to facilitate production, 4) using a single ball size for all stages, and 5) improving the speed and efficiency of the stimulation process.

It is thus one aspect of embodiments of the present invention to provide a downhole tool that seals a selected portion of a wellbore between geologic formations while simultaneously allowing access to a tubular annulus defined between the interior of a casing string or open-hole wellbore and a production string positioned therein. According to at least one embodiment, the downhole tool is integrated by a threaded connection, or any similar connection commonly practiced in the art, into a tubular production string that is positioned within the wellbore. The downhole tool provides a path for fluids or tools to enter the tubular annulus and simultaneously isolates downstream portions of the tubular production string from the high pressures exerted by a stimulation procedure, e.g., hydraulic fracturing. Additionally, with the use of packers or cement to isolate the tubular annulus, the downhole tool isolates non-targeted stimulation zones from the high pressures exerted by a stimulation procedure. As used herein, packers may be swellable, hydraulic, mechanical, inflatable, or any other alternative known in the art. The downhole tool in some instances eliminates the need to perforate various strings of pipe or position other tools into the wellbore, thus saving time, costs, and the inherent risk of trapping a tool. The downhole tool may be constructed of metallic or non-metallic materials, such as the composite materials currently used in composite bridge plugs, and typically combinations of both.

It is another aspect of embodiments of the present invention to provide a downhole tool that employs a flapper valve that is capable of moving between a first position and a second position to selectively open and close an axial bore and a lateral bore of the downhole tool. The axial bore of the downhole tool opens to and is in fluid communication with an internal bore of the tubular string. The lateral bore of the downhole tool opens to and creates a passageway to the tubular annulus. The flapper valve may be associated with a sealing element fabricated of an elastomeric, plastic, metallic, or any other sealing element known to one of ordinary skill in the art. In some embodiments, the flapper valve may be comprised of degradable materials. For example, after a predetermined period of time, the flapper valve may dissolve to allow production fluid to flow unrestricted through the axial and lateral bores of the downhole tool. A degradable flapper valve is disclosed in U.S. Pat. No. 7,287,596, which is incorporated herein by reference in its entirety.

When in the first position, the flapper valve seals the lateral bore of the downhole tool such that fluid may be pumped through the axial bore of the downhole tool. The axial bore of the downhole tool may also allow passage of solid elements, such as wireline tools, tubing, coiled tubing conveyed tools, cementing plugs, balls, darts, and any other elements known in the art. The sealing area of the first position may be irregular in shape and comprised of several sealing surfaces.

When in the second position, the flapper valve seals the axial bore of the downhole tool, thereby sealing the internal bore of the tubular string and allowing fluid to be pumped to the tubular annulus through the lateral bore of the downhole tool. The movement of the flapper from the first position to the second position effectively seals the downstream stimulation zone and opens a passageway to the tubular annulus, allowing the next stimulation zone to be immediately treated.

It is another aspect of embodiments of the present invention to provide a restraining mechanism for maintaining the flapper in the first position. The restraining mechanism may be a ring, finger, a tubular member, such as a sleeve, or any other restraining device. The restraining mechanism exerts a force against the flapper valve to prevent external forces acting upon the outside of the flapper valve, such as the external pressures associated with circulating a fluid in the tubular annulus, from unseating the flapper valve from its first position. When the restraining device is disengaged, the flapper valve is free to move to the second position. According to at least one embodiment, the restraining mechanism is disengaged by an actuating mechanism deployed on electric wireline, a slickline, coiled tubing, jointed tubing, solid rods, or drop members. Examples of drop members include balls, plugs, darts, or any other members commonly used in the art. As used herein, 'ball' refers to any shaped device that is feasible of being pumped down a tubular string and is not limited to a circular-shaped device. For example, a 'ball' may be circular, oval, oblong, or any other shape known in the art.

It is another aspect of embodiments of the present invention to provide a flapper valve that is biased toward the second position by a coiled spring, leaf spring band, or other similar energy storage system. The stored energy assists the movement of the flapper valve toward the second position. According to at least one embodiment, a spring is placed in the body of the downhole tool, and compressed, storing mechanical energy to aid in the movement of the flapper valve from the first position to the second position. Additionally, an explosive device may be used to assist the flapper valve movement. For example, cement located in the tubular annulus may interfere with flapper movement and the spring or explosive device would aid in breaking the flapper valve away from the cement. The activating tool used to move the flapper valve-restraining device also may assist in the movement of the flapper valve from the first position to the second position.

It is another aspect of embodiments of the present invention to provide a downhole tool that is activated with drop members from the surface using a multi-pressure activation system. The multi-pressure activation system exposes the downhole tool to a predetermined pressure to selectively actuate a sliding sleeve that receives a drop member. For example, in one embodiment, a first higher pressure does not actuate the sliding sleeve. Instead, the higher pressure causes the drop member to pass through the axial bore of the downhole tool, by use of a spring operated catch mechanism, and travel through the internal bore of the tubular string to the next tool or to the distal end of the wellbore. The higher pressure may either deform the drop member to allow it to pass through the axial bore of the downhole tool or actuate a ball catch mechanism, such as a collet slidable device, collet deformable fingers, or any other ball catch mechanism currently employed in the art. Collet slidable devices are disclosed in U.S. Pat. Nos. 4,729,432, 4,823,882, 4,893,678, 5,244,044, and 7,373,974, which are incorporated herein by reference in their entireties. Collet deformable fingers are disclosed in U.S. Pat. Nos. 4,292,988 and 5,146,992, which are incorporated herein by reference in their entireties.

In the above mentioned embodiment, a second lower pressure does not allow the drop member to pass through the axial bore of the downhole tool. Rather, the lower pressure keeps the drop member trapped, under pressure, in the axial bore of the downhole tool. The lower pressure is held for a period of time until the sliding sleeve moves, thereby allowing the flapper valve to move from the first position to the second position to block the axial bore of the tubular string and to open the lateral bore of the downhole tool.

In operation, the drop member would be inserted into the tubular string. Once the drop member lands and engages the sleeve of a downhole tool, a higher pressure would be exerted at the surface of the wellbore. The higher pressure would cause the drop member to pass through that downhole tool without sleeve actuation, and continue to pass through each tool distally in the wellbore until the desired tool is reached. The sleeve of the desired downhole tool would then be activated by applying the lower pressure, which would move the sleeve and allow the flapper valve to actuate from the first position to the second position. Fracture stimulation materials may then be selectively pumped through the internal bore of the tubular string, through the lateral bore of the downhole tool, and into the tubular annulus.

In another embodiment, utilizing hydraulics in the catch mechanism would allow a drop member to pass under a lower pressure; shifting would occur only under a higher pressure.

Another aspect of embodiments of the present invention is to provide a sliding sleeve associated with a reservoir of hydraulic oil or other fluid that allows the sliding sleeve to shift, thereby freeing the flapper valve to move from the first position to the second position. The hydraulic oil or other fluid bleeds through an orifice to a second reservoir allowing the sliding sleeve to move over a period of time from an initial position to a position that allows the flapper to move. The sliding sleeve may be moved back to its first position by means of a spring or other stored energy device, which would in turn transfer the hydraulic fluid back through the orifice to the first reservoir.

It is another aspect of embodiments of the present invention to provide a locking mechanism for securing a sliding sleeve in a shifted position. The locking mechanism prevents the sliding sleeve from shifting back to its initial position, thereby ensuring that the sliding sleeve does not disengage the flapper valve from its second position.

It is another aspect of embodiments of the present invention to provide a downhole tool that is activated by coiled tubing or small diameter jointed tubing. In this embodiment, the treatment for a given wellbore stimulation would be pumped in an annulus formed between the coiled tubing, solid rods, and the inner surface of a tubular string, thereby allowing the coiled tubing to function as a dead string to monitor down hole treating pressures. A tool located at the end of the coiled tubing engages a shifting sleeve associated with the tubing string that is held in place by shear pins or any other similar device. The use of coiled tubing as the actuating tool allows an unlimited number of treatment stages to be performed in a well, thus providing an advantage over frac baffles, for example, which require smaller actuation balls to be used to engage frac baffles in more distal positions in the wellbore. Additionally, using coiled tubing as the activation member removes the need for pressurizing fluid pumped from the surface as described above, and the coiled tubing may be used to cleanout proppant between fracing stages.

Another aspect of embodiments of the present invention is to provide a downhole tool utilizing a shifting sleeve that closes the tubular production string at a predetermined location and opens the annulus of the wellbore to allow fracing or other stimulation procedures in stages. In one embodiment a counter is embedded in the shifting sleeve and a uniform size ball is dropped into the well. Each shifting sleeve is preset with a unique counter number such that the counter locks in place after the proper number of balls have passed, catching and retaining the next ball. The ball then closes off the wellbore and shifts a sliding sleeve, opening the annulus and geologic formation to be treated at a predetermined depth or interval. The counter locking mechanism is designed to facilitate normal completion operations including flow back during screen out. As used herein, counting means refers to any form of counter that can increment and/or decrement. Sleeve activation means identifies any means that facilitates movement of an inner tubular member, such as a sleeve. For example, sleeve activation means include pressure activation, mechanical activation, and electronic activation techniques. Signal means identifies any form of electronic signal that is capable of conveying information.

Another aspect of embodiments of the present invention is to provide a swellable ball that is dropped into the well and a downhole tool utilizing a sliding sleeve. The ball is configured to swell after a predetermined period of time in a fluid, such as fracing fluid. In operation, the swellable ball is pumped quickly to the correct location. The location can be verified by counting pressure spikes, which result from the ball passing through a seat disposed in a sliding sleeve. Once the swellable ball is located in the tubular string proximal to the sleeve to be shifted, pumping is discontinued. Thus, the swellable ball would be allowed to swell to a size that would prevent the ball from passing through the selected sleeve. The operator would then continue pumping.

Another aspect of embodiments of the present invention is to provide a smart ball that is dropped into the well and a downhole tool utilizing a sliding sleeve. In one embodiment, the shifting sleeve has an embedded radio frequency identification ("RFID") chip and the smart ball has an RFID reader built into it. When the ball passes the RFID chip, the RFID reader reads the number of the RFID chip. If the correct number is read, the ball releases a mechanism that expands the size of the ball. For example, the expansion could be a split in the middle of the ball that rotates part of the ball slightly. Alternatively, the top ⅓ of the ball may be hinged and would open upon the correct number being read. The larger ball would become stuck in the next seat. In another embodiment, the smart ball includes a timer that causes the ball to expand after a certain period of time. For example, in this embodiment, an operator would count the pressure spikes and stop pumping when the ball is in the right location and wait for the timer to go off. Pumping would then resume.

Another aspect of embodiments of the present invention is to provide a ball that is dropped into the well and a downhole tool utilizing a smart sleeve. In one embodiment, each sleeve has an RFID reader and the ball has an RFID chip. When the correct ball passes, the device releases a mechanism to catch the ball, plugging the orifice and shifting the sleeve. In another embodiment, each sleeve has a pressure transducer and circuit board with logic to understand pressure signals. The sleeve receives hydraulic pressure signals from a signal generator on the surface. The proper signal triggers the sleeve to shift, thus opening the annulus and creating a seat for the ball to land on. Then, a ball is dropped to close off the axial bore of the tubular production string.

It is another aspect of the present invention to provide a method for selectively treating multiple portions of a production wellbore, whether from the same geologic formation or different formations penetrated by the same wellbore. In one embodiment, a single sized ball is utilized multiple times to move a sleeve which isolates a lower portion of the wellbore, while providing communication to the annulus to treat the formation at a predetermined depth. After that zone is treated, subsequent balls of the same size are used to isolate and treat other zones at a shallower depth. After all the zones are treated, all of the balls may flow back to the surface, or disintegrate if manufactured from degradable materials. Dissolvable balls are disclosed in U.S. Patent Publication No. 2010/0294510, which is herein incorporated by reference in its entirety.

It is still yet another aspect of embodiments of the present invention to provide a downhole tool that employs an external cover associated with the lateral bore of the downhole tool. The external cover prevents debris, such as cement, from interfering with the movement of the flapper from the first position to the second position. The external cover may be removed or deformed by fluid pumped through the internal bore of the tubular string and the axial bore of the downhole tool. Coiled tubing carrying fluids alone or fluids with abrasive particles may also be used to remove or deform the external cover, which will also form a tunnel through the cement to the formation. It is another aspect of embodiments of the present invention to provide a downhole tool that is used with external tubular packers positioned within the tubular annulus to isolate a stimulation zone and to prevent clogging of the lateral bore. External casing packers, conventional packers, swellable packers, or any other similar devices may be employed. External tubular packers isolate the frac zone and/or prevent cement from contacting the external portion of the downhole tool and blocking the lateral bore.

Another aspect of embodiments of the present invention is to provide a downhole tool that facilitates tools exiting the tubular string through the lateral bore. According to at least one embodiment, the flapper valve may be longer in one axis such that when the flapper valve moves to the second position, it forms a whipstock slide that is angled with respect to a longitudinal axis of the tubular string. The whipstock slide guides drilling or workover tools to the lateral bore of the downhole tool. If the lateral bore is blocked by an external cover or by debris, the blockage may be removed by milling, drilling, acid, or other fluid, including abrasive particle laden fluids. Using the flapper valve as a whipstock slide may be particularly useful for short and ultra-short radius horizontal boreholes where the tubular string is the origin. The flapper valve may have an orienting mechanism, such as a crowsfoot's key that is commonly used to orient tools in a specified azimuth. When the flapper valve is in the second position, the orienting mechanism orients the tools to the lateral bore.

According to another aspect of embodiments of the present invention, the downhole tool may include several longitudinally spaced flapper valves. Additionally, numerous smaller flapper valves could be arranged around the circumference of the downhole tool. The smaller flapper valves could be activated by an activating member as described above to open one or more additional bores to the tubular annulus. After being released by an activating member, the smaller flapper valves would move toward a second position, which may be disposed in a recess about the body of the downhole tool so as not to block the axial bore of the downhole tool.

It is another aspect of embodiments of the present invention to provide a downhole tool that includes a flapper valve that does not open a lateral bore to the tubular annulus. In these embodiments, movement of an inner tubular member, such as a sleeve, opens ports to the annulus that allow fluid exchange between the axial bore of the tubular string and the subterranean formation. The movement of the inner tubular member allows the flapper valve to block the axial bore of the tubular string and thereby prevent fluid flow through the axial bore of the downhole tool to portions of the tubular string located downstream of the actuated flapper valve.

It is another aspect of embodiments of the present invention to provide a downhole tool that may be used as a blowout preventer that prevents a large volume of fluid from passing upward through the internal bore of the tubular string. According to at least one embodiment, a downhole tool includes a flapper valve and an inner tubular member. The flapper has two stationary positions, a first position and a second position. When the flapper valve is in the first position, fluid may be freely pumped through the axial bore of the downhole tool. When the flapper is in the second position, the internal bore of the tubular string is sealed such that fluids downstream of the flapper valve cannot flow upward through the axial bore of the downhole tool. In this embodiment, the inner tubular member is pressure activated and comprises a ball, a ball seat, a ball cage, and flow restriction orifices. The inner tubular member is held in place by shear pins or any other similar means known in the art that are responsive to axial force.

The inner tubular member allows fluid to be pumped from the surface in normal circulation and in reverse circulation. During normal circulation, fluid flows down the tubular string through the ball seat and the flow restriction orifices of the inner tubular member. The ball cage restricts the ball from moving distally in the tubular string. During reverse circulation, fluid flows up the tubular string causing the ball to seat in the ball seat, thus limiting the upward fluid flow by requiring the fluid to flow through flow restriction orifices. If a large volume of fluid attempted to pass upward through the downhole tool, such as in a blowout situation, the friction pressure through the orifices would overcome the shear pins, or any other similar means and shift the inner tubular member upwards. The upward shift of the inner tubular member allows the flapper valve to move from the first position to the second position. Once in the second position, the flapper valve seals the internal bore of the tubular member and fluid flow up the internal bore of the tubular string would be prevented. The flapper valve may have a sealing element fabricated of an elastomeric, plastic, metallic, or any other sealing elements customarily used in the art to prevent fluids from flowing up the inner bore of the tubular string. The sealing elements may be disposed on the flapper or on a flapper seat. Additionally, the downhole tool may include multiple flapper valves.

According to at least one embodiment of the present invention, a downhole tool adapted for use in a tubular string to selectively treat one or more hydrocarbon production zones is provided, the downhole tool comprising: an upper end and a lower end adapted for interconnection to a tubular string; a catch mechanism positioned proximate to said lower end and adapted to selectively catch or release a ball traveling through said tubular string; a sleeve which travels in a longitudinal direction between a first position and a second position, and which is actuated based on an internal pressure in the tubular string, said sleeve preventing a flow of a treatment fluid in a lateral direction into an annulus of the wellbore while in said first position, and permitting the flow of the treatment fluid in the lateral direction through at least one port in said second position; and a locking mechanism positioned proximate to said catch mechanism, wherein when said catch mechanism is engaged with said locking mechanism, said sleeve is in said second position and said treatment fluid cannot be pumped downstream of said catch mechanism in the tubular string.

According to at least another embodiment of the present invention, a method for treating a plurality of hydrocarbon production zones at different locations in one or more geologic formations is disclosed, the method comprising: providing a wellbore with an upper end, a lower end and a plurality of producing zones positioned therebetween; positioning a string of production tubing in the wellbore, said string of production tubing having an upper end and a lower end; providing a plurality of selective opening tools in said production string, each of said selectively opening tools having a catch mechanism adapted to selectively catch or release a ball traveling through said tubular string, a sleeve which travels in a longitudinal direction between a first position and a second position and which is actuated based on an internal pressure in the tubular string, said sleeve preventing a flow of a treatment fluid in a lateral direction into an annulus of the wellbore while in said first position, and permitting the flow of the treatment fluid in the lateral direction through at least one port in said second position, and a locking mechanism positioned proximate to said catch mechanism, wherein when said catch mechanism is engaged with said locking mechanism, said sleeve is in said second position and said treatment fluid cannot be pumped downstream of said catch mechanism in the tubular string; pumping a treatment fluid containing a ball through the production tubing at a predetermined first pressure until said ball engages the catch mechanism of a first selective opening tool positioned proximate to a first portion of the hydrocarbon production zone; maintaining said first pressure in said production tubing for a pre-determined period of time to displace said catch mechanism of said first tool and engage the locking mechanism of said first tool wherein a sleeve of said first tool is in a second position; pumping the treatment fluid into said first portion of said at least one geologic formation; reducing the pressure in said production tubing wherein said catch mechanism disengages from said locking mechanism and said sleeve returns to said first position; pumping said treatment fluid at a predetermined second pressure until said ball engages and passes through said catch mechanism of said first selective opening tool, said second pressure higher than said first pressure; reducing said treatment fluid pressure to said first pressure to position said ball in a catch mechanism of a second selective opening tool positioned proximate to a second zone of the hydrocarbon production zone, wherein said catch mechanism engages a locking mechanism of said second tool wherein a sleeve of said second tool is in second position; pumping the treatment fluid into said second portion of said at least one geologic formation.

According to yet another embodiment of the present invention, system adapted for use in a tubular string for treating one or more hydrocarbon production zones, comprising: a plurality of downhole tools, each comprising: an upper end and a lower end adapted for interconnection to a tubular string; a catch mechanism positioned proximate to said lower end and adapted to selectively catch or release a ball traveling through said tubular string; a sleeve which travels in a longitudinal direction between a first position and a second position, and which is actuated based on an internal pressure in the tubular string, said sleeve preventing a flow of a treatment fluid in a lateral direction into an annulus of the wellbore while in said first position, and permitting the flow of the treatment fluid in the lateral direction through at least one port in said second position; and a locking mechanism positioned distal to said catch mechanism, wherein when said catch mechanism is engaged with said locking mechanism, said sleeve is in said second position and said treatment fluid cannot be pumped downstream of said catch mechanism in the tubular string; wherein when a treatment fluid containing a ball is pumped into said tubular string at a predetermined first pressure, said ball displaces a catch mechanism of a first downhole tool until engaging a locking mechanism of said first tool wherein a sleeve of said first tool is in a second position; wherein when a treatment fluid containing a ball is pumped into said tubular string at a predetermined second pressure greater than said first pressure, said ball passes through said catch mechanism of said first downhole tool until engaging a catch mechanism of a second downhole tool.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
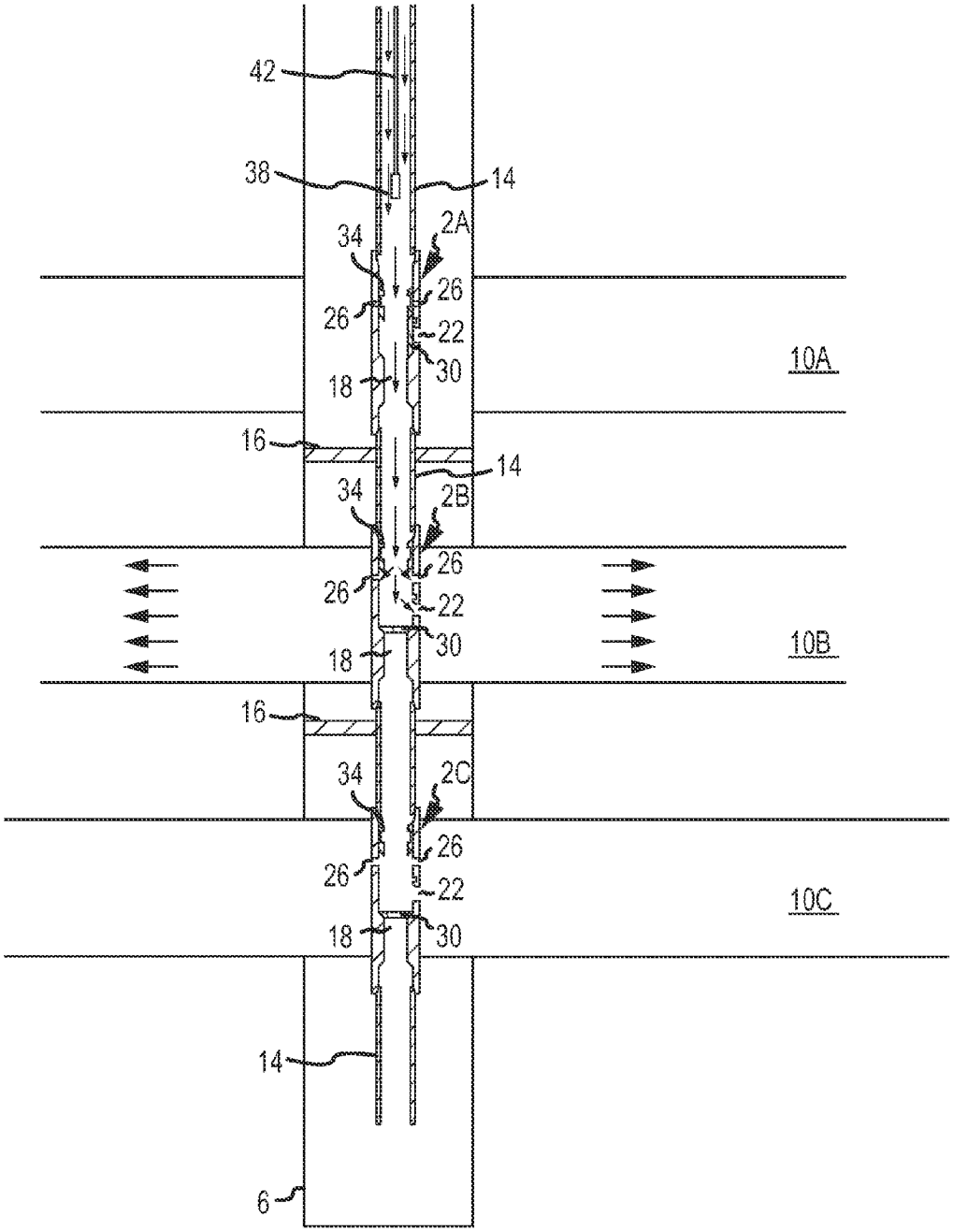
FIG. 1 is a cross-sectional view of a fracture stimulation system according to one embodiment of the present invention.

In certain instances, details that are not necessary for an understanding of the invention or that render other details difficult to perceive may have been omitted. It should be understood, of course, that the invention is not necessarily limited to the particular embodiments illustrated herein.

To assist in the understanding of one embodiment of the present invention the following list of components and associated numbering found in the drawings is provided.

| # | Components |
|---|---|
| 2 | Downhole tool |
| 6 | Wellbore |
| 10 | Subterranean formation |
| 14 | Tubular string |
| 16 | Packer |
| 18 | Axial bore |

-continued

| # | Components |
|---|---|
| 22 | Lateral bore |
| 26 | Fracture ports |
| 30 | Flapper valve |
| 34 | Sliding sleeve |
| 38 | Stimulation fluid |
| 42 | Shifting tool |
| 46 | Production fluid |
| 50 | Shear pins |
| 54 | Hinge |
| 58 | Torsion spring |
| 62 | Compression spring |
| 66 | Fracturing zones |
| 70 | Sleeve |
| 74 | High pressure |
| 78 | Drop member |
| 82 | Catch mechanism |
| 86 | Lower pressure |
| 88 | Flange |
| 90 | Spring |
| 92 | Spring force |
| 94 | Upper reservoir |
| 98 | Lower reservoir |
| 102 | Orifice |
| 106 | Radial port |
| 110 | Seals |
| 114 | Weep hole |
| 118 | Sleeve locking mechanism |
| 122 | Recess |
| 126 | Downhole tool |
| 130 | Shifting sleeve |
| 132 | Counter assembly |
| 134 | Counter mechanism |
| 138 | Counter locking mechanism |
| 142 | Rocker mechanism |
| 146 | Counter spring |
| 150 | Counter window |
| 154 | Perforations |
| 158 | Protrusion |
| 162 | Chamber |
| 166 | Pressure equalization device |
| 170 | Manual setting mechanism |
| 174 | Trip pin |
| 178 | Gears |
| 180 | Counter wheels |
| 182 | Inner shaft |
| 186 | Sliding lock |
| 190 | Anchor |
| 192 | Treatment fluid |
| 194 | Radial button |
| 196 | Rack |
| 198 | Gear |
| 206 | Fill material |
| 210 | Inner tubular member |
| 212 | Outer tubular member |
| 214 | Sealing element |
| 218 | Ball |
| $218_A$ | Ball position A |
| $218_B$ | Ball position B |
| 222 | Ball seat |
| 226 | Ball cage |
| 230 | Flow restriction orifices |
| 240 | Piston |
| $240_A$ | Piston position A |
| $240_B$ | Piston position B |
| 242 | Fluid reservoir |
| 250 | Catch/Release Mechanism |
| 252 | Collet Finger |
| 254 | Major inner diameter |
| 256 | Minor inner diameter |
| 258 | Deformed distal collet finger |
| 260 | Locking mechanism |
| 270 | Locking dog |

DETAILED DESCRIPTION

Figure 2:
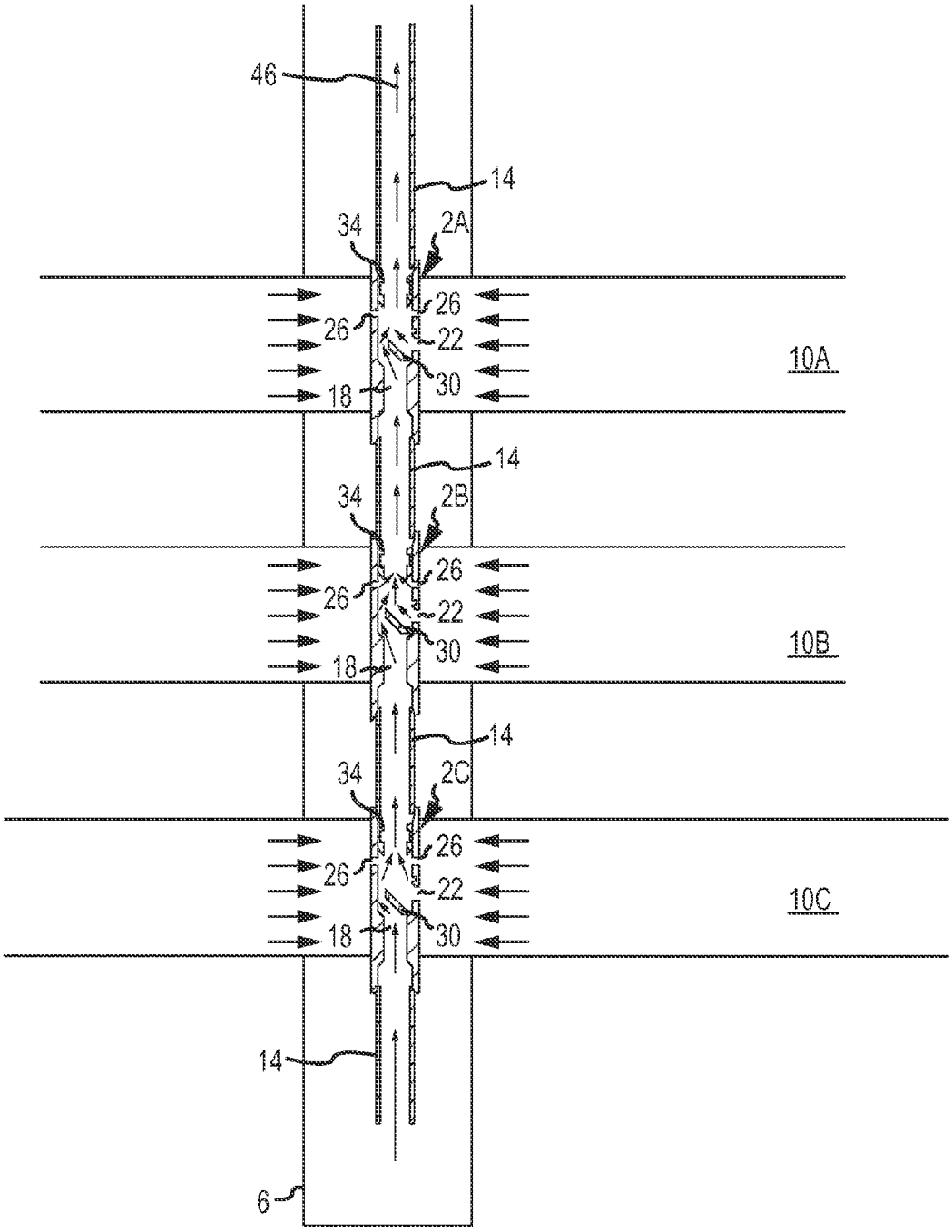
FIG. 2 is a cross-sectional view of a well production system according to one embodiment of the present invention.

FIGS. 1 and 2 show one embodiment of the present invention in which at least one downhole tool 2 and associated tubular string 14 is disposed in a wellbore 6. According to this embodiment, the wellbore 6 is drilled through a subterranean formation. As shown in FIGS. 1 and 2, three tools 2 are connected to a tubular string 14. Each tool 2 is vertically disposed within a formation 10A, 10B, 10C that has been selected to be fracture stimulated and/or produced. One of skill in the art will appreciate that packers, cement, or other sealants may be located on either side of the formation 10A, 10B, and 10C to provide annular hydraulic isolation. As shown in FIG. 1, packers 16 provide annular hydraulic isolation of formation 10B. In this embodiment, each tool 2 has an axial bore 18, a lateral bore 22, fracture ports 26, a flapper valve 30, and a sliding sleeve 34.

Referring now to FIG. 1, a fracture stimulation of a multiple zone formation is shown. As illustrated, the lower formation 10C has been fracture stimulated, the intermediate zone 10B is currently being fracture stimulated, and the upper zone 10A will be fracture stimulated in the future. Stimulation fluid 38 flows down the tubular string 14 (which includes downhole tools 2A, 2B and 2C), through the downhole tool 2A and into the downhole tool 2B (identifying Tool 2 in formation B). As shown, the downhole tool 2B has been actuated wherein the flapper valve 30 blocks the axial bore 18 of tool 2B, thereby preventing fluid from entering a distal portion of the tubular string 14 below the flapper valve 30 of tool 2B. The fluid 38 flows through the frac ports 26 and the lateral bore 22 of the downhole tool 2B into the intermediate zone 10B. Portions of the tubular string 14 not associated with the zone being stimulated may be isolated by cement, packers, etc.

After the fracture stimulation of the intermediate zone 10B is completed, a shifting tool 42 is conveyed down the tubular string 14 to the downhole tool 2A. The shifting tool 42 activates the downhole tool 2A by shifting the sleeve 34, thereby releasing the flapper valve 30. Once released, the flapper valve 30 moves toward its second position and blocks the axial bore 18 of the downhole tool 2A to fracturing zone 10A prevent fluid from flowing distally in the tubular string 14. The second position may be held in place by a variety of locking means that are well known to one of ordinary skill in the art. The shifting tool 42 is removed from the tubular string 14 or repositioned within the tubular string 14 to the next stimulation zone. Stimulation fluid 38 is then pumped down the tubular string 14, through the activated tool 2A, and into the fracturing zone 10A. As will be appreciated by one skilled in the art, this fracture sequence can be repeated without limit in a wellbore. Additionally, more than one downhole tool 2 may be deployed within each formation 10.

Referring now to FIG. 2, production of a multiple zone formation is shown. As illustrated in FIG. 2, three vertically displaced (or horizontally placed zones in a directional well) formations 10 are producing fluid and/or gas (hereinafter "fluid"). The three downhole tools 2 integrated into the tubular string 14 allow the production fluid 46 to enter and flow up the tubular string 14. Flapper valves 30 open in response to fluid flow and pressure, allowing flow from both outside and below the downhole tool 2. As shown, production fluid 46 is flowing from the stimulated zones 10 through the frac ports 26 and the lateral bore 22 of the vertically displaced tools 2 into the tubular string 14. Once in the tubular string 14, the production fluid 46 flows up the tubular string 14. The flapper valve 30 in each respective tool 2 is moved between a first position, where the lateral bore 22 is blocked, and a second position, in which the flapper valve 30 blocks the axial bore 18, in response to fluid flow and pressure from outside and below the respective tool 2.

Figures 3, 4:
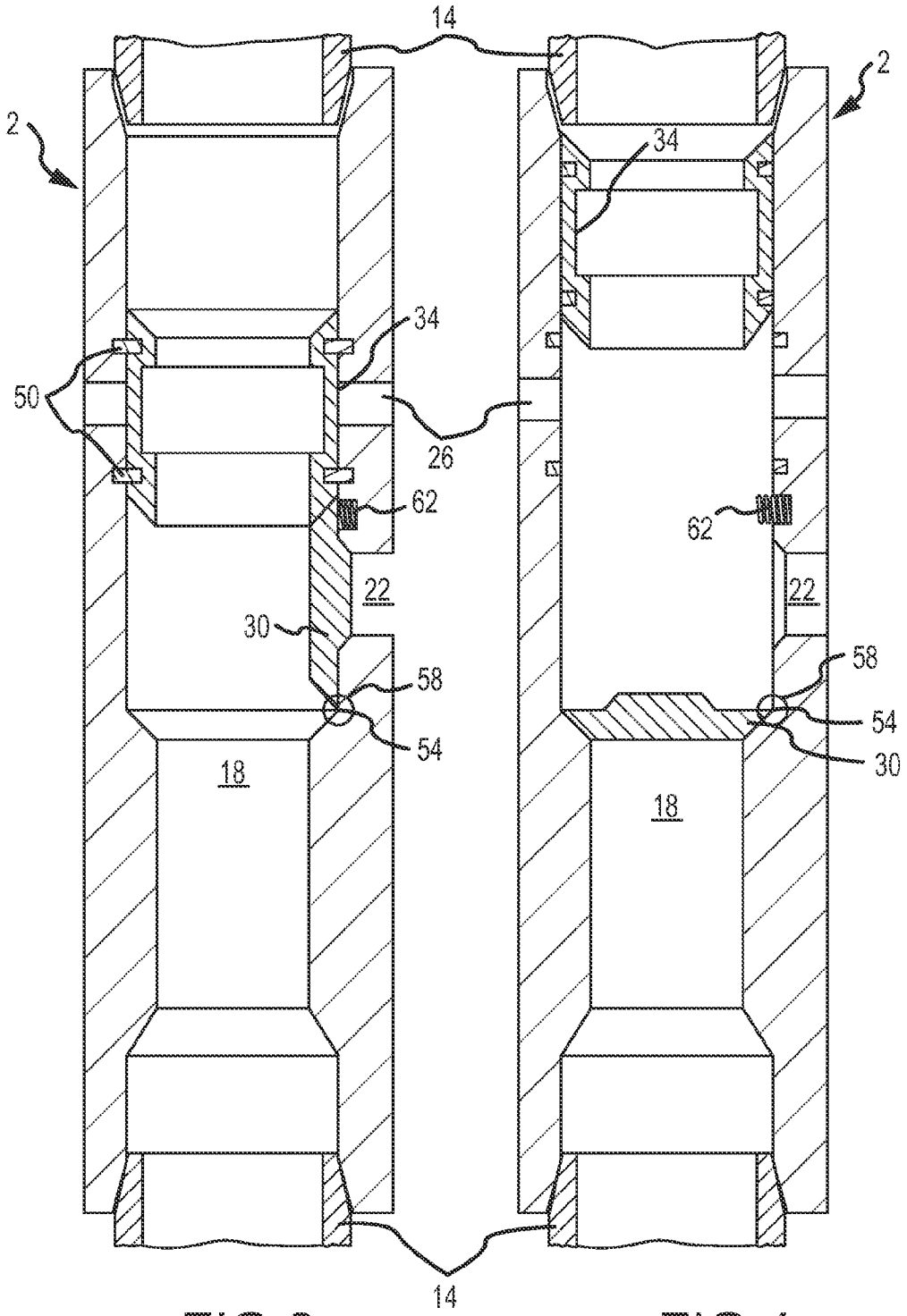
FIG. 3 is a cross-sectional view of a downhole tool that is actuated by a shifting tool according to one embodiment of the present invention.
FIG. 4 is another cross-sectional view of the embodiment of FIG. 3.

FIGS. 3 and 4 show a downhole tool according to another embodiment of the present invention. According to this embodiment, a sleeve 34 restrains a flapper valve 30 in its first position, thus closing a lateral bore 22 of the downhole tool 2. A shifting tool shifts the sleeve 34, thereby releasing the flapper valve 30 and allowing the flapper valve 30 to move toward its second position.

FIG. 3 shows the flapper valve 30 is restrained in its first position by the sleeve 34. The sleeve 34 is held in place by shear pins 50, which prevent the sleeve 34 from moving within the tubular string 14. In this position, the axial bore 18 of the downhole tool 2 allows fluids and solid elements to pass through the downhole tool 2 into distal portions of the tubular string 14, and the flapper valve 30 blocks access to a tubular annulus formed between the tubular string 14 and the wellbore. The sleeve 34 blocks the ports 26 and the flapper valve 30 blocks the lateral bore 22.

Referring now to FIG. 4, the sleeve 34 has been shifted in the downhole tool 2, thereby releasing a flapper valve 30 from its first position. A hinge 54 connected to the bottom of the flapper valve 30 allows rotation. A torsion spring 58 connected to the bottom of the flapper valve 30 biases the flapper valve 30 towards its second position. A compressed spring 62 also may be included in the body of the downhole tool 2 to assist the movement of the flapper valve 30 from its first position toward its second position. As shown, the flapper valve 30 is in its second position to seal the axial bore 18 of the downhole tool 2, thereby preventing fluid from flowing downward into distal portions of the tubular string 14. Frac ports 26 and the lateral bore 22 of the downhole tool 2 create passageways to the annulus of the tubular string 14. As will be appreciated by one of skill in the art, the lateral bore 22 is optional. Accordingly, in some embodiments, fluid exchange occurs solely through the frac ports 26.

Figure 5:
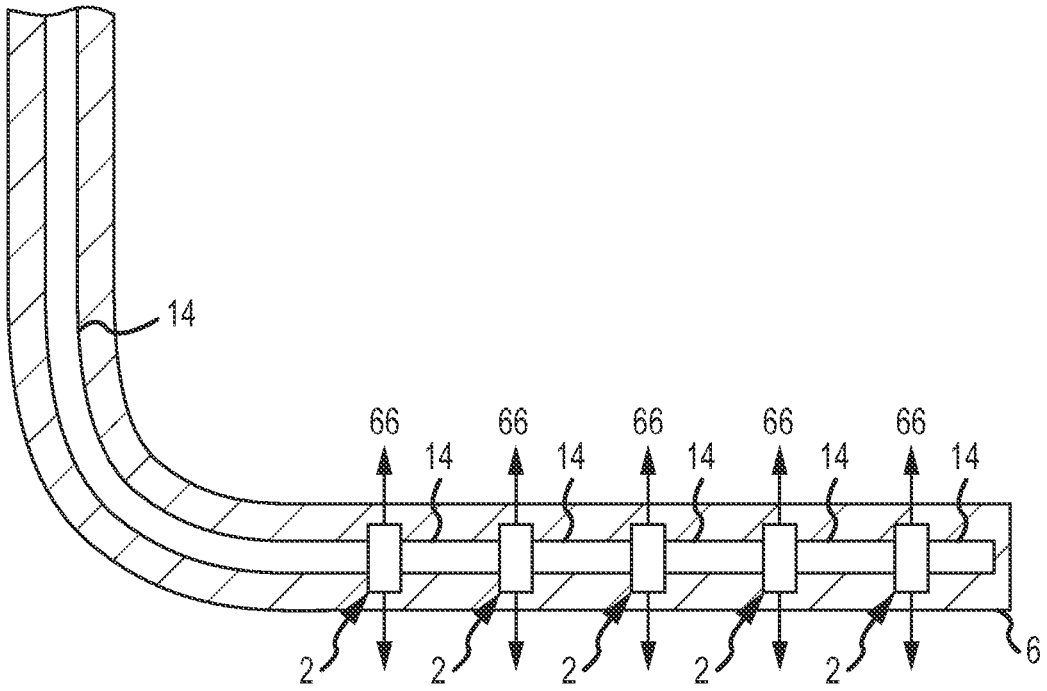
FIG. 5 is a cross sectional view of a horizontal well with multiple fracturing stages.

Referring now to FIG. 5, a horizontal well with multiple producing zones is shown. As illustrated, a wellbore 6 is depicted which contains five fractured zones 66. At least one downhole tool 2 but preferably five in this example may be disposed within the wellbore to isolate and allow production from the different zones in the geologic formation. Each of the downhole tools 2 may be activated by a sleeve 34 as discussed above or by a pressure activation system to allow the selective treatment of each zone and subsequent production simultaneously, thus optimizing economic performance of the producing formation. Although not shown, the fractured producing zones may be hydraulically isolated with packers or cement, for example, to isolate the annular space between the tubular string 14 and the wellbore or casing.

Figure 6:
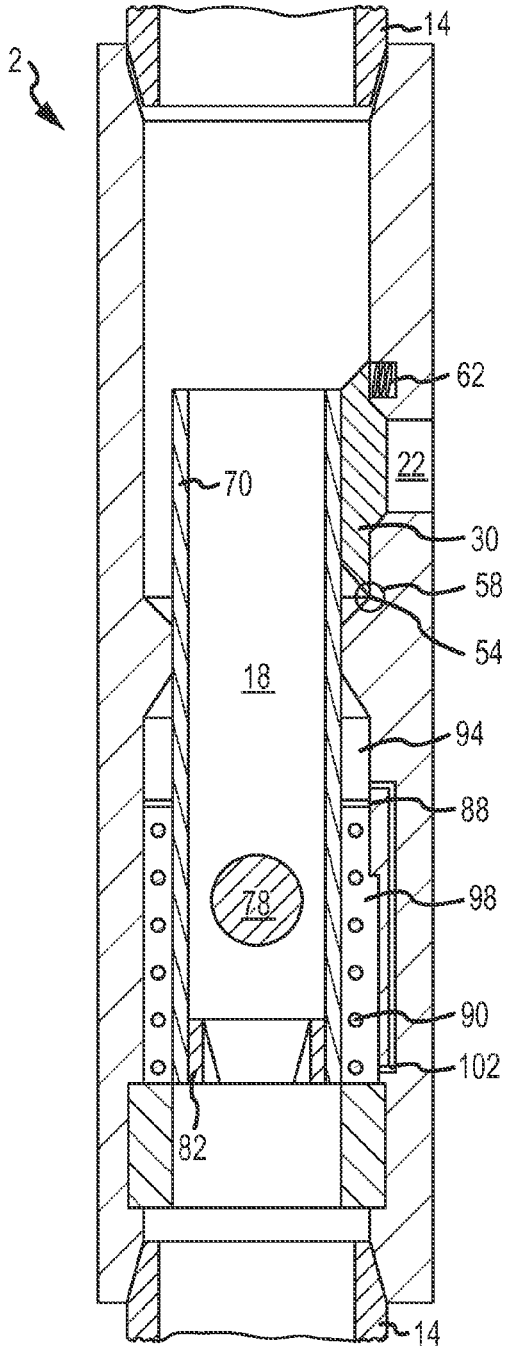
FIG. 6 is a cross-sectional view of a downhole tool that is actuated by a pressure activation system according to one embodiment of the present invention.
Figure 7:
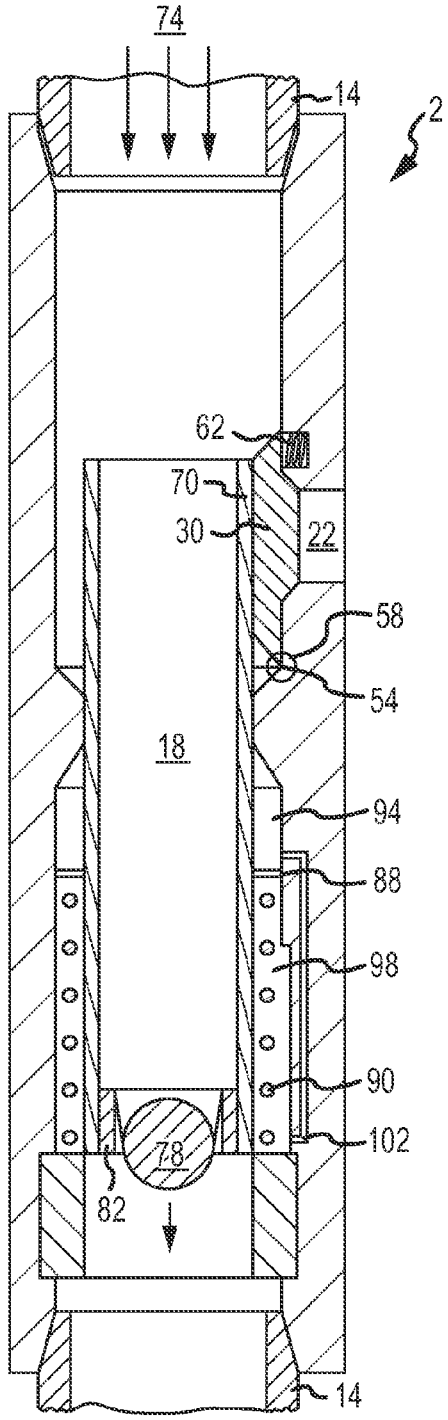
FIG. 7 is another cross-sectional view of the embodiment of FIG. 6.
Figure 8:
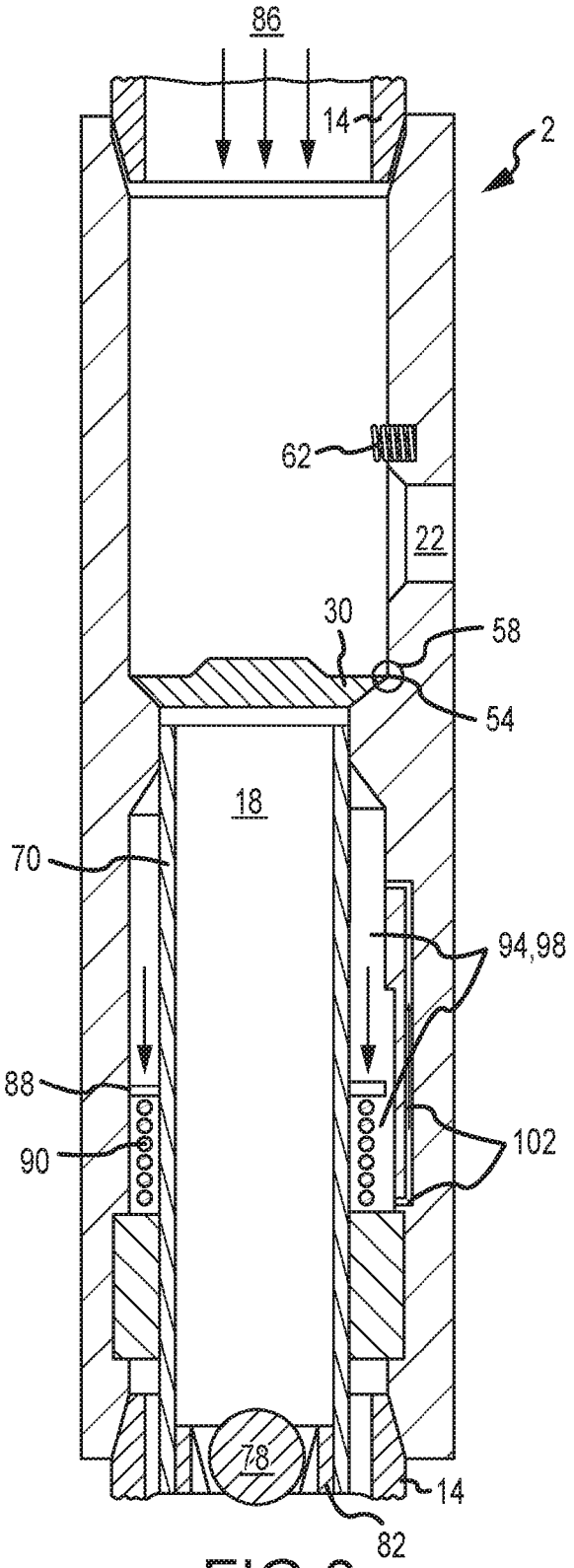
FIG. 8 is yet another cross-sectional view of the embodiment of FIG. 6.

FIGS. 6-8 illustrate a downhole tool 2 according to another embodiment wherein the downhole tool 2 is actuated by a pressure activation system. More specifically, the sleeve 70 is pressure activated such that the flapper valve 30 is released depending on the pressure exerted into the tubular string 14. In operation, a high pressure 74 applied to the tubular string 14 does not actuate a downhole tool 2. Instead, the high pressure 74 causes a drop member 78, such as a ball, to pass through a downhole tool 2 and travel to the next tool 2 in the tubular string 14 or to the distal portion of the wellbore 6. The drop member 78 passes through the downhole tool 2 by deforming or by actuating a catch mechanism 82, as shown in FIGS. 6-8.

A lower pressure 86 actuates the downhole tool 2 by shifting the sleeve 70, thereby releasing a flapper valve 30 and allowing it to move from its first position to its second position. More specifically, the lower pressure 86 acts upon the drop member 78, which is lodged in the catch mechanism 82, to slide the sleeve 70 away from the flapper valve 30. Using a flange 88, the sleeve contacts and compresses a spring 90 as it moves. The sleeve 70 is associated with an upper reservoir 94, a lower reservoir 98, and an orifice 102 for fluid passage. The outer surface of the sleeve 70 forms a boundary between the reservoirs 94, 98 and the internal bore of the downhole tool 2, and seals the reservoirs 94, 98 from pressure in the tubular string. Sealing elements may be provided to enhance the seal between the sleeve 70 and the reservoirs 94, 98. Once the sleeve 70 is moved a predetermined distance, the flapper valve 30 is able to release. In one embodiment, a high pressure 74 of about 3000 psi causes the drop member 78 to pass through a downhole tool 2, and a lower pressure 86 of about 1000 psi maintained in the tubular string 14 for roughly 15 seconds causes the drop member 78 to move the sleeve 70. One of ordinary skill in the art would understand this embodiment uses a similar mechanism to that of a hydraulic fishing jar. As will be appreciated by one of skill in the art, the pressures may vary depending on design of the sleeve 70, the drop member 78, the catch mechanism 82, and the spring 90. Further design criteria include the depth of the wellbore, pressure from the producing formation, diameter of tubing string 14, etc.

FIG. 8 shows a shifted sleeve 70 and a released flapper valve 30 in its second position. Once the sleeve 70 no longer abuts the flapper valve 30, a torsion spring 58 will rotate the flapper valve 30 from its first position toward its second position, thereby blocking the axial bore 18 of the downhole tool and opening the lateral bore 22 of the downhole tool. An additional spring 62 may be used to assist the movement of the flapper valve 30 from its first position towards the second position.

FIGS. 9-12 illustrate a downhole tool 2 actuated by a pressure activation system according to another embodiment of the present invention. The downhole tool 2 shown in FIGS. 9-12 operates in a similar fashion as that described above in connection with FIGS. 6-8. A flapper valve 30 is shown in FIGS. 9-12; however, in some embodiments, the flapper valve 30 is not included in the downhole tool 2. In these embodiments, the sleeve 70 blocks access to the tubular annulus while in a non-shifted position. A drop member 78 shifts the sleeve 70 to allow access to the subterranean formation through openings formed in the circumference of the downhole tool 2. The drop member 78 remains seated in the catch mechanism 82 during stimulation of the selected stage to isolate downstream portions of the tubular string from the stimulation fluid and/or proppant.

Figure 9:
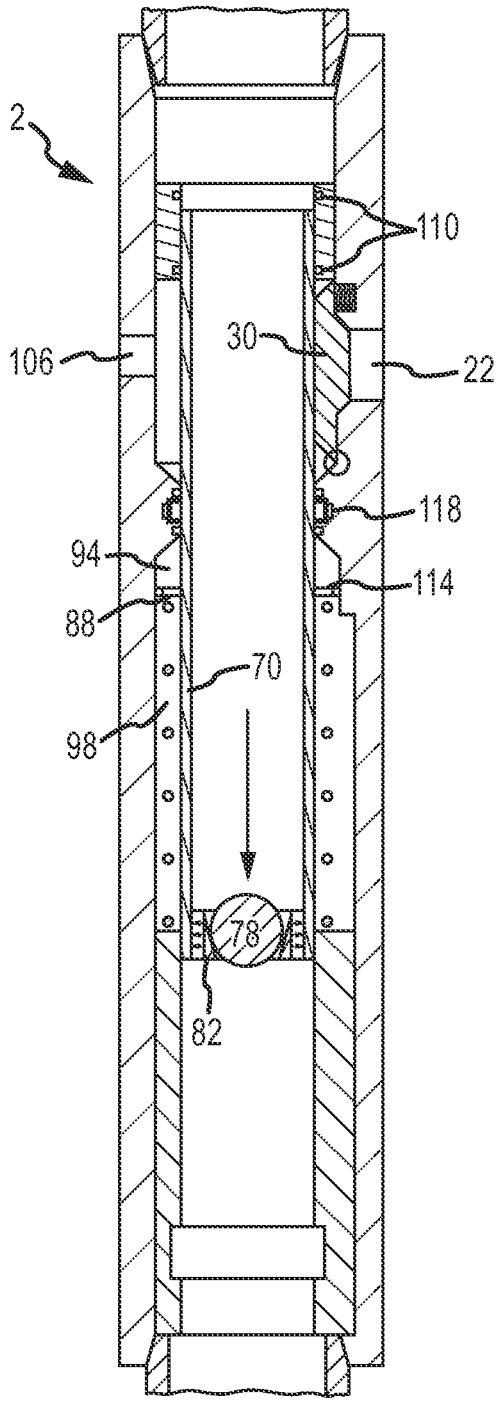
FIG. 9 is a cross-sectional view of a downhole tool that is actuated by a pressure activation system according to another embodiment of the present invention.

Referring to FIG. 9, a sleeve 70 is disposed in an initial, non-shifted position. As shown, the sleeve 70 blocks access to the tubular annulus through a radial port 106 and restrains the flapper valve 30 in its first position, thereby blocking lateral bore 22. Seals 110 provide a fluid tight engagement between the sleeve 70 and the downhole tool 2, thus preventing fluid exchange between the tubular production string and the tubular annulus. The sleeve 70 is interconnected to a flange 88, which is associated with an upper reservoir 94 and a lower reservoir 98. The flange 88 has a weep hole 114 that allows fluid exchange between the upper and lower reservoirs. In operation, the weep hole 114 acts like a dashpot and resists motion of the sleeve 70. The rate of fluid exchange between the upper and lower reservoirs increases once the flange 88 enters the larger cross-sectional reservoir area. Accordingly, in at least one embodiment, the sleeve 70 shifts at two different rates. Initially, the sleeve 70 shifts at a slow rate because of the restricted fluid flow through the weep hole 114. However, once the sleeve has shifted to the point that the flange 88 enters the larger cross-section reservoir area, the sleeve shifts at an increased rate because of the increased fluid flow path between the upper reservoir 94 and the lower reservoir 98.

Figure 10:
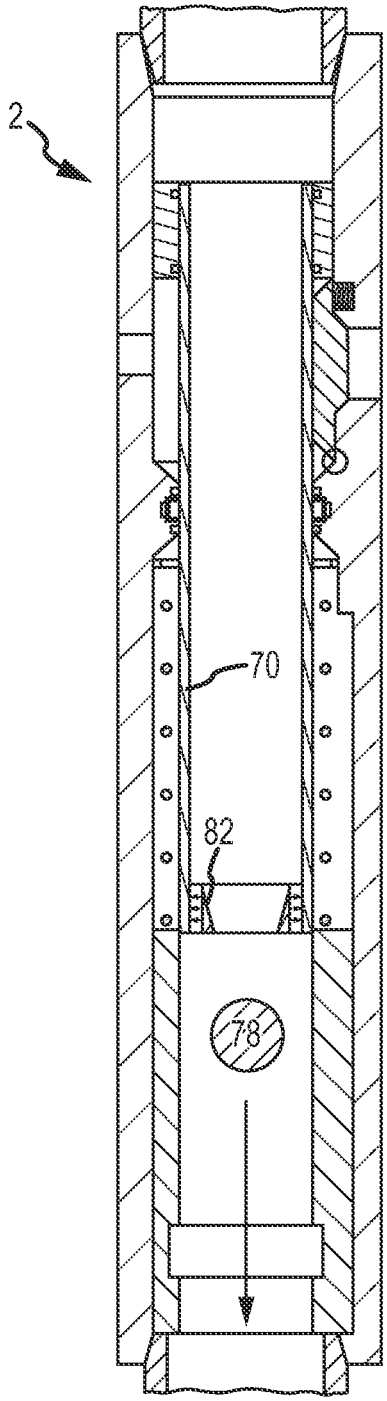
FIG. 10 is a cross-sectional view of the downhole tool shown in FIG. 9 in a non-shifted position.

As illustrated in FIG. 9, a drop member 78 is seated in a catch mechanism 82. At higher pressures, the drop member 78 passes through the catch mechanism 82 and travels to the next downhole tool 2 in the tubular production string, as shown in FIG. 10. At lower pressures, the drop member 78 remains seated in the catch mechanism 82 and moves the sleeve 70 into a shifted position, as shown in FIG. 11.

Referring to FIG. 10, the sleeve 70 remains in a non-shifted position and the drop member 78 has passed through the catch mechanism 82 and is travelling through the tubular string toward a downstream tool 2 disposed in the tubular production string. Referring to FIG. 11, the drop member 78 has shifted the sleeve 70, thus allowing the flapper valve 30 to isolate the downstream portions of the tubular production string. A sleeve locking mechanism 118 prevents the sleeve 70 from shifting upward in the downhole tool 2 and unseating the flapper 30 from its second position. As shown, the sleeve locking mechanism 118 is spring loaded. Alternative actuation methods, as known in the art, may be used to activate the sleeve locking mechanism 118. Additionally, the sleeve locking mechanism 118 may have the ability to reset to its original position, thereby allowing the sleeve 70 to reset to its initial non-shifted position.

Figure 11:
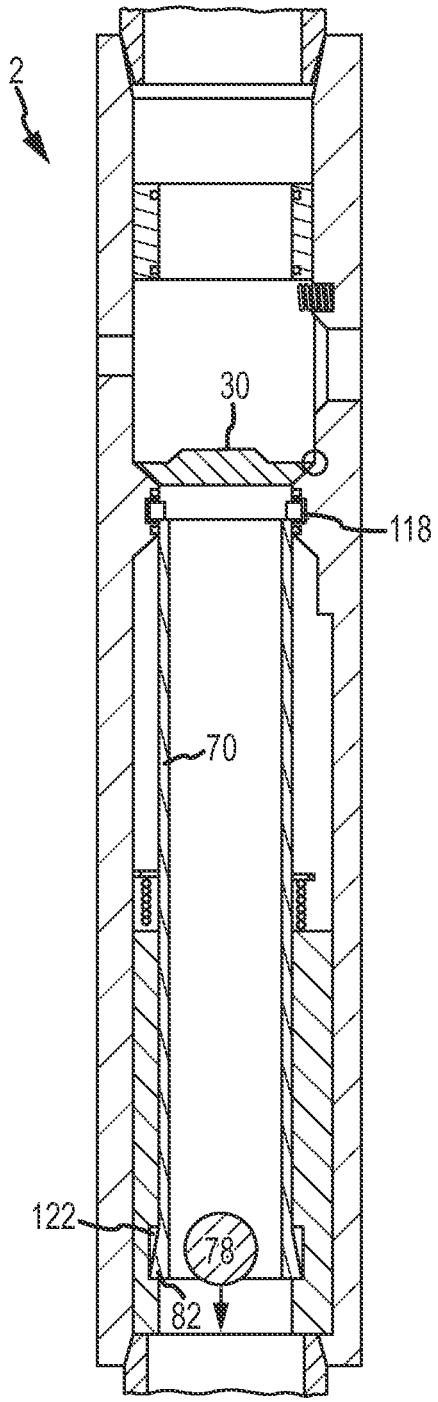
FIG. 11 is a cross-sectional view of the downhole tool shown in FIG. 9 in a shifted position.

FIG. 11 also depicts a recess 122 in the downhole tool 2 configured to receive the catch mechanism 82. In one embodiment, the catch mechanism 82 has an undeformed outer diameter that is larger than the inner diameter of the downhole tool 2. Accordingly, in this embodiment, the inner diameter of the downhole tool 2 constrains the outer diameter of the catch mechanism 82. By providing a selectively positioned recess 122 in the downhole tool 2, the catch mechanism 82 is allowed to expand into the recess 122 when the sleeve 70 is in a shifted position. This expansion allows the full inner diameter of the sleeve to be utilized for ball return during flow back operations. In one configuration, the catch mechanism 82 is a spring loaded collet assembly.

Figure 12:
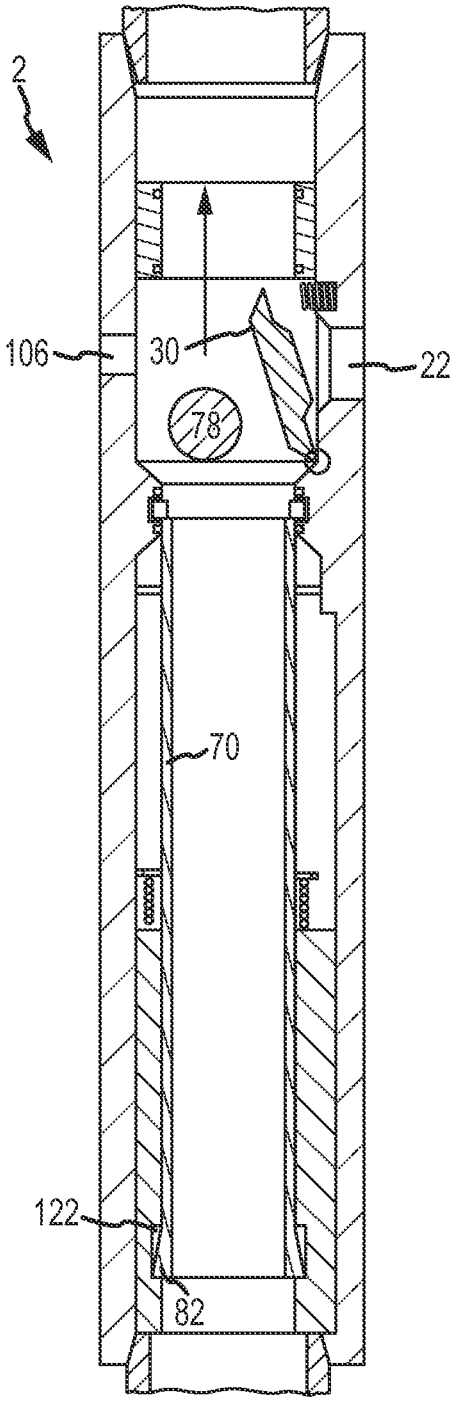
FIG. 12 is a cross-sectional view of the downhole tool shown in FIG. 11 during flow-back.

Referring to FIG. 12, the downhole tool 2 is shown during flow back. As shown, the flapper valve 30 has rotated toward its first position, thereby allowing the drop member 78 to flow up the tubular string from distal portions of the wellbore. Additionally, the catch mechanism 82 has retracted into a recess 122 formed in downhole tool 2. This retraction allows the full bore of the tubular string to be utilized and prevents the catch mechanism 82 from interfering with the return of the drop members 78 to the surface during flow back. In some configurations, the flapper valve 30 may be locked in its first position during flow back by a latching mechanism. Locking the flapper 30 in its first position would increase the flow up the axial bore 18 of the tubular production string while allowing flow from the stimulated zones to continue through the ports 106. FIGS. 13-19 depict a downhole tool 126 that is actuated by a pressure activation system according to another embodiment of the present invention. Downhole tools 126 are selectively disposed within stimulation stages according to a predetermined stimulation process. Each downhole tool 126 utilizes a counter to actuate a sliding sleeve. Each counter is associated with a stimulation stage and is preset to a predetermined number. The counter indexes for every drop member 78 that passes through the downhole tool 126. After the predetermined number is reached, the counter prevents subsequent drop members 78 from passing through the downhole tool 126 to downstream portions of the tubular production string. Accordingly, each drop member 78 that is dropped proceeds to a predetermined stage number. Once at the predetermined stage number, the drop member 78 seats in a catch mechanism and seals the axial bore of the tubular production string. Increased pressure in the tubular production string upstream of the predetermined stage number shifts the predetermined tool 126 and allows access to the subterranean formation through openings in the tubular production string.

Figure 13:
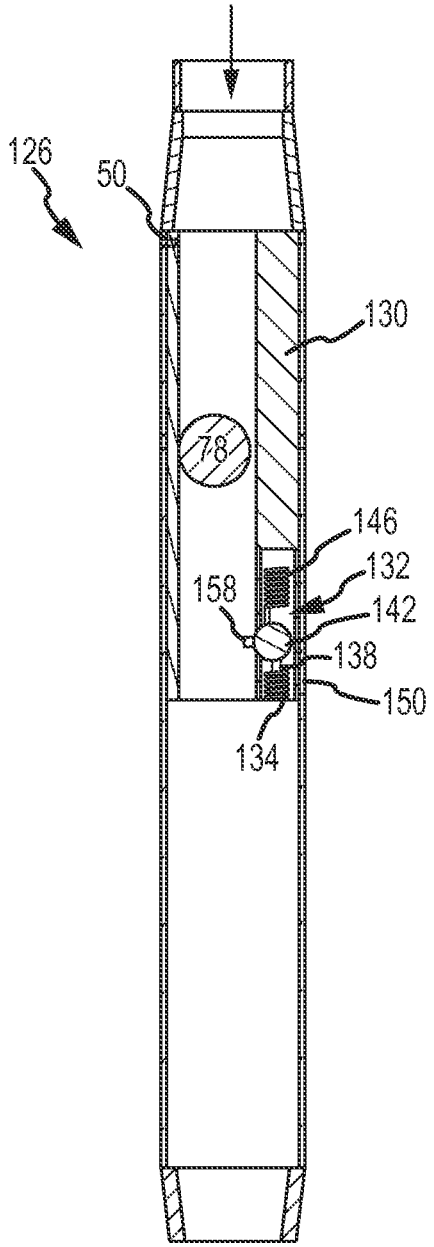
FIG. 13 is a cross-sectional view of a downhole tool that is actuated by a counter system according to yet another embodiment of the present invention.

Referring to FIG. 13, a cross-sectional view of the downhole tool 126 in a pre-shifted position is illustrated. In the pre-shifted position, the downhole tool 126 allows fluid and/or proppant to pass through the downhole tool 126 to the stage being stimulated while restricting access to openings formed in the downhole tool 126. The downhole tool 126 utilizes a shifting sleeve 130 that may be secured in a pre-shifted position by a shear pin 50. The shifting sleeve 130 employs a counter assembly 132 to activate shifting of the sleeve 130. The design of the counter assembly 132 may vary, as will be appreciated by one of skill in the art. As shown in FIG. 13, the counter assembly 132 includes a counter mechanism 134, a locking mechanism 138, a rocker mechanism 142, a counter spring 146, and a catch mechanism, such as a protrusion 158. In at least one embodiment, the counter assembly includes a manual setting mechanism 170 that allows the counter mechanism 134 to be incremented or decremented manually through buttons or levers. In an alternative embodiment, an electronic setting mechanism may be provided that allows an operator to remotely set the counter to a predetermined number. The preset number for the counter mechanism 134 may be revealed in a window 150 constructed of suitable transparent materials, such as Lexan or other similar materials. The window 150 may be viewed either from the sidewall of the pipe or by looking down the tubular before installation.

Figure 14:
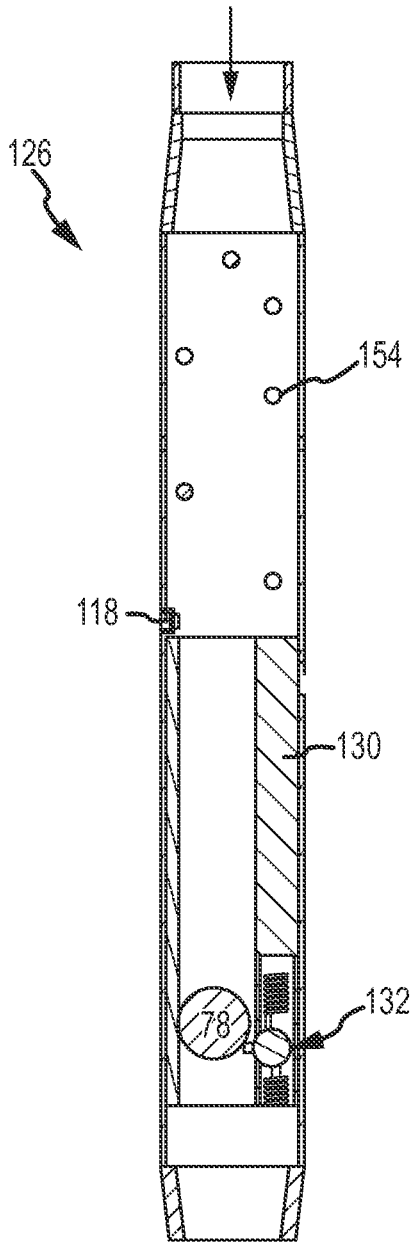
FIG. 14 is a cross-sectional view of the downhole tool shown in FIG. 13 in a shifted position.

FIG. 14 depicts the downhole tool 126 in a shifted position, revealing perforations 154 in the tubular production string. In the shifted position, the downhole tool 126 allows fluid and/or proppant to pass through the perforations 154 while restricting access to downstream portions of the tubular production string. As illustrated in FIG. 14, the drop member 78 remains lodged in the shifting sleeve 130 and restricts flow that might otherwise pass on to stages that have already been stimulated. After stimulation, the drop member 78 is no longer needed to seal the inner bore of the downhole tool 126 and thus is allowed to flow back to the surface. As shown, a sleeve locking mechanism 118 prevents the shifting sleeve 130 from shifting back into its pre-shift position.

Figure 15:
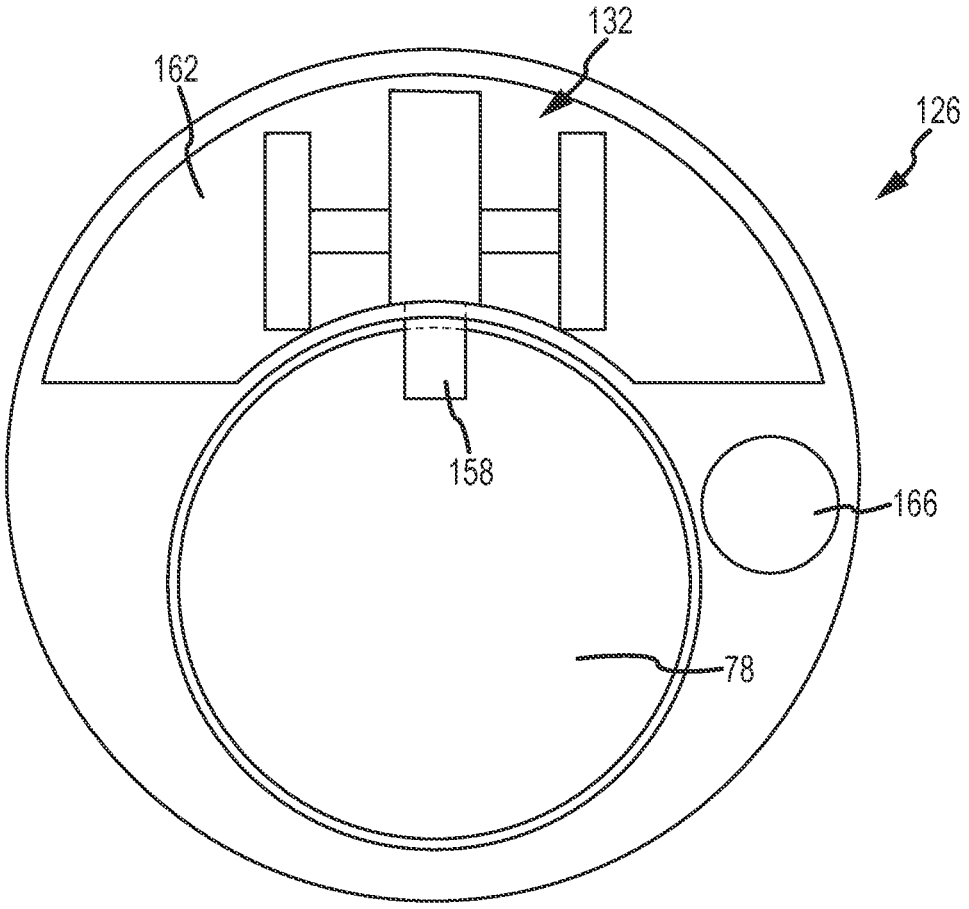
FIG. 15 is an end view of the downhole tool shown in FIG. 13.

FIG. 15 illustrates a simplified end view of the downhole tool 126 with a drop member 78 disposed therein. In FIG. 15, the counter mechanism 134, the locking mechanism 138, and the counter spring 146 are not shown for simplicity reasons. As illustrated, the drop member 78 is seated on the protrusion 158 and substantially seals the inner bore of the downhole tool 126. To prevent sand or other proppants from interfering with the gears of the counter assembly 132 and to ensure adequate lubrication thereof, the counter assembly 132 may be housed in a chamber 162 that is filled with oil or other fluid. A pressure equalization device 166, such as a pressure regulator, may be used to ensure that the pressure inside the chamber 162 does not drop substantially below the pressure in the tubular production string, thus minimizing the likelihood of contaminants reaching the counter assembly and ensuring proper operation of the counter assembly 132. The pressure equalization device 166 is in fluidic communication with the chamber 162 and the inner bore of the tubular production string, and isolates the fluid in the chamber 162 from the fluid and proppants in the tubular production string. In at least one embodiment the pressure equalization device is a piston and cylinder. Additionally, a sealing element may be provided between the counter assembly and the inner bore of the tubular string to further isolate the counter assembly 132 from contaminants.

Figure 16:
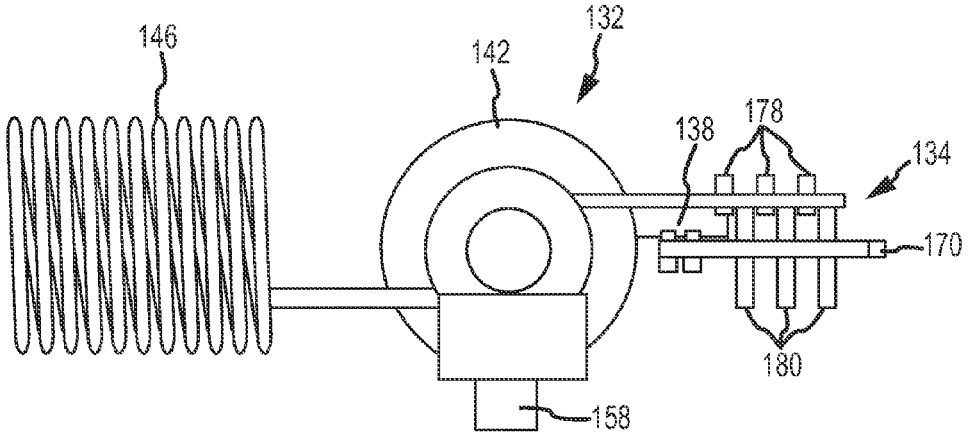
FIG. 16 is a side view of the counter assembly shown in FIG. 13.
Figure 17:
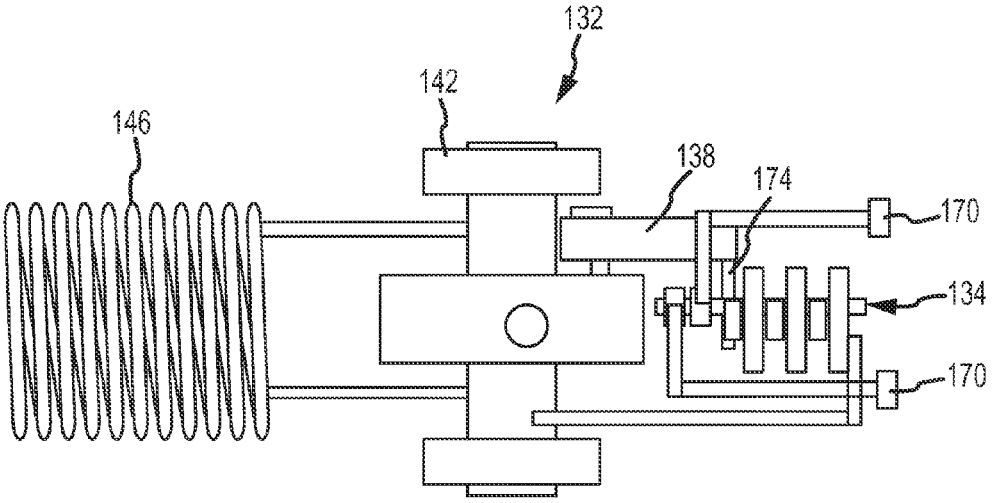
FIG. 17 is a top view of the counter assembly shown in FIG. 16.

FIGS. 16-19 illustrate in detail one embodiment of a counter assembly 132. As shown in FIGS. 16-19, the counter assembly 132 includes a counter mechanism 134, a locking mechanism 138, a rocker mechanism 142, a counter spring 146, and a manual setting mechanism 170. Referring to FIGS. 16-17, a catch mechanism, such as a protrusion 158, interconnects with the rocker mechanism 142. The rocker mechanism 142 interconnects to a counter mechanism 134, a locking mechanism 138, and a spring 146. Upon contact with a drop member, the protrusion 158 rotates the rocker mechanism 142 and allows the drop member to pass through the internal bore of the downhole tool 126. Upon rotation of the rocker mechanism 142, the counter mechanism 134 indexes a running count number. Once the running count number reaches a predetermined number, the counter mechanism 134 moves a trip pin 174 which allows the locking mechanism 138 to shift, thereby preventing subsequent drop members from passing through the downhole tool 126 to downstream portions of the tubular string. In some embodiments, the counter mechanism generates an electronic signal to activate the locking mechanism. In these embodiments, once the predetermined number is reached, an electronic signal is sent to the locking mechanism, which shifts into a locked position upon receipt of the signal. In some embodiments, the counter mechanism also may generate an electronic signal to activate shifting of an inner tubular member, such as a sleeve. In these embodiments, the sleeve would not be activated by an internal pressure within the tubular string.

A manual setting mechanism 170 allows the counter mechanism 134 to be incremented or decremented manually through buttons or levers, thereby allowing the counter mechanism 134 to be preset to a predetermined number. As discussed above, an electronic setting mechanism may be provided that allows an operator to remotely set the counter to a predetermined number. Accordingly, the counter mechanism 134 is settable such that each tool 126 in the tubular production string will have a unique number and will lock out only after the proper numbers of balls have passed by it. The counter assembly 132 also includes a counter spring 146 that interconnects with the rocker mechanism 142 and restrains rotation of the rocker mechanism 142. The counter spring 146 is configured to prevent the counter assembly 132 from counting when fracing fluid with or without proppant is passed through the downhole tool under typical fracing conditions. Accordingly, the counter spring 146 ensures that the rocker mechanism 142 will rotate only under the force of a drop member 78 seated on the catch mechanism. The counter spring 146 is illustrated as a linear spring; however, in some embodiments the counter spring 146 may be a torsion spring disposed on the shaft of the rocker mechanism 142.

As depicted in FIGS. 16-17, the counter assembly 132 incorporates a plurality of gears 178 and a plurality of counter wheels 180 to enable counting to a predetermined number, which in turn facilitates engagement of the locking mechanism 138. The counter mechanism 134 may incorporate geneva gears or other incrementing/decrementing gears to facilitate proper counting. For example, the device may have a gear for 1's, 10's and 100's places and may use geneva gears or other incrementing gears to facilitate proper counting between these places.

As previously mentioned, the design of the counter assembly 132 may vary without departing from the scope of present disclosure. For example, in one embodiment, the counter is a disk that rotates to release the ball. In another embodiment, a button or section of the wall may move in the radial direction to allow the ball to pass and decrement the counter. As a further example, instead of utilizing a catch mechanism interconnected with a rocker mechanism 142, the catch mechanism could translate in and out of the inner bore of the tubular production string to actuate a click counter. In this configuration, the motion of the protrusion 158 would be orthogonal to the central axis of the tubular production string. The orthogonal motion would actuate the counter mechanism 134 in a similar fashion as a hand-held clicker. Once the predetermined number is reached, the counter mechanism 134 would activate the locking mechanism 138 to prevent orthogonal movement of the protrusion. In this example, the protrusion 158 may have sloped surfaces to enable a drop member to force the protrusion 158 into the chamber 162 and to pass by the protrusion 158.

Figure 18:
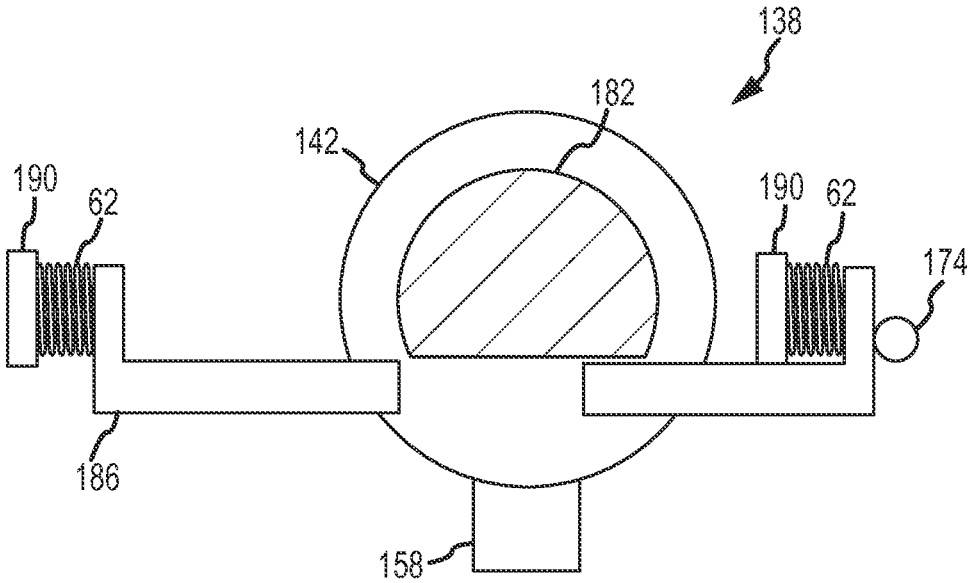
FIG. 18 is a side view of a locking mechanism in a clockwise lock position.
Figure 19:
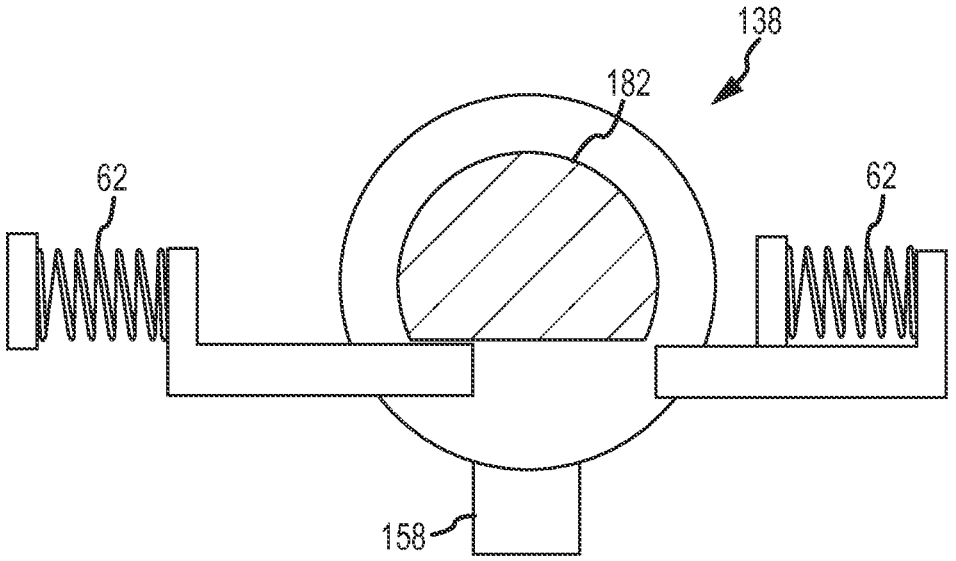
FIG. 19 is a side view of the locking mechanism of FIG. 18 in a counterclockwise lock position.

FIGS. 18-19 depict an embodiment of the locking mechanism 138. In FIGS. 18-19, a trip pin 174 is disposed toward a lower, or downstream, end of the downhole tool 126. Accordingly, during normal flow, the direction of fluid flow is from left to right in FIGS. 18-19. Referring to FIG. 18, the locking mechanism 138 is in a clockwise lock position. As illustrated, a sliding lock 186 prevents an inner shaft 182 of the rocker mechanism 142 from rotating clockwise, but allows the inner shaft 182 to rotate counterclockwise. A compression spring 62 biases the sliding lock 186 against a trip pin 174 and is disposed between the sliding lock 186 and an anchor 190 that is interconnected with the sleeve 130. As shown in FIG. 17, the trip pin 174 is interconnected with the counter mechanism 134. Once a predetermined number of drop members passes by the counter assembly 132, the counter mechanism 134 pulls the pin 174. Accordingly, in the clockwise lock position, the locking mechanism 138 allows drop members, such as balls, to pass by the counter assembly 132 to distal portions of the tubular production string. However, the locking mechanism 138 prevents drop members from passing by the counter assembly 132 in a reverse direction toward the surface.

Referring to FIG. 19, the trip pin 174 has been pulled by the counter mechanism 134. As shown, the compression spring 62 has shifted the sliding lock 186 into a counterclockwise lock position. In this position, the sliding lock 186 prevents the inner shaft 182 from rotating counterclockwise, but allows the inner shaft to rotate clockwise. The compression spring 62 maintains the sliding lock 186 in this counterclockwise lock position. By preventing counterclockwise rotation, the lock mechanism 138 prevents drop members from passing to downstream portions of the tubular production string. Thus, once the lock mechanism 138 is in this lock position, a subsequent drop member will seat on the protrusion 158 and substantially seal the inner bore of the tubular production string. Internal pressure will build in the inner bore of the tubular production string, thus shifting the sleeve 130 associated with the counterclockwise locked counter assembly 132 into a shifted position. Accordingly, in the counterclockwise lock position, the locking mechanism 138 allows drop members, such as balls, to pass by the counter assembly 132 toward the surface. However, the locking mechanism 138 prevents drop members from passing by the counter assembly 132 to distal portions of the tubular production string.

Figure 20:
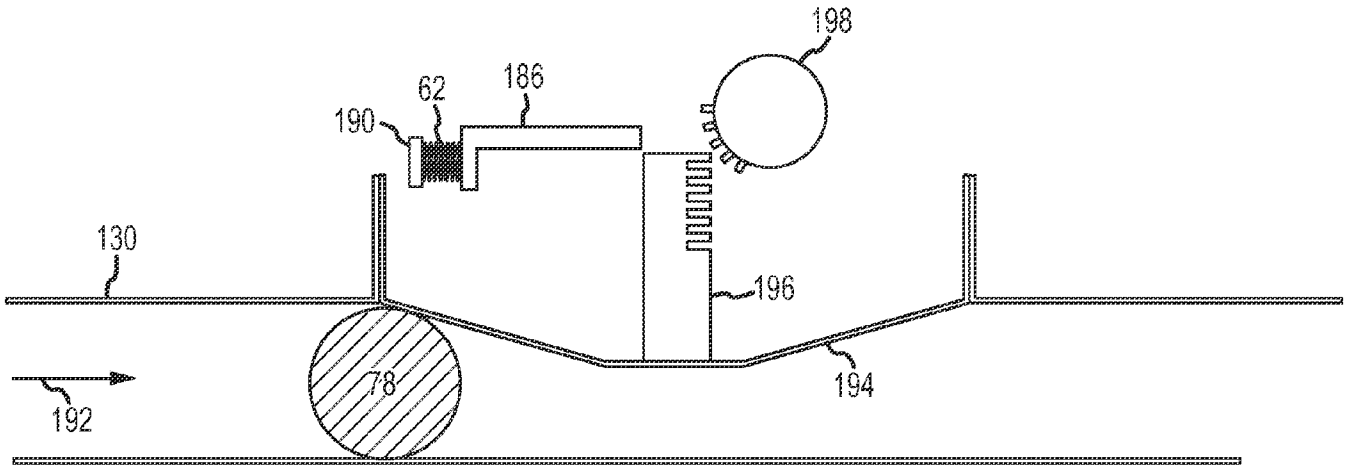
FIG. 20 is a side view of a counter assembly according to another embodiment of the present invention.
Figure 21:
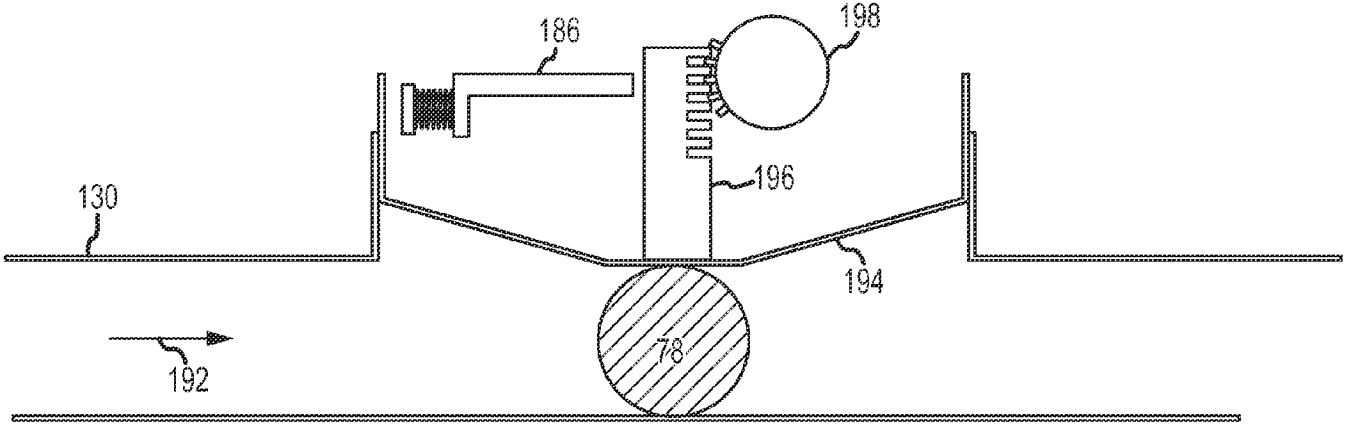
FIG. 21 is another side view of the counter assembly shown in FIG. 20.

FIGS. 20-21 depict a counter assembly according to another embodiment of the present invention wherein the counter assembly utilizes a button or section of the sleeve wall to allow a ball to pass and decrement the counter. In general, FIGS. 20-21 illustrate a linear actuation method of incrementing/decrementing a counter. Referring to FIGS. 20-21, treatment fluid 192 is flowing toward distal portions of the tubular string. A button 194 has sloped surfaces and extends into an internal bore of a sleeve 130. The button 194 is interconnected to a rack 196, which is configured to intermesh with a gear 198 to increment/decrement a counter. The gear 198 may be, for example, a counter gear or a worm gear that is interconnected with a counter mechanism. A sliding lock 186 is interconnected with a spring 62, an anchor 190, and is in mechanical or electrical communication with a counter mechanism. Once a predetermined number of balls have passed by the button 194, the counter mechanism will activate the sliding lock 186 to prevent subsequent balls from passing by the button 194. As shown in FIG. 20, a drop member 78 has contacted the button 194. The sliding lock 186 is not engaged, and thus the ball may depress the button in a direction orthogonal to the fluid flow 192 and continue flowing toward distal portions of the tubular string. Referring to FIG. 21, the drop member 78 has depressed the button 194 into the body of the sleeve 130, and the rack 196 has engaged the gear 198, thereby causing the gear 198 to rotate. The rotation of the gear 198 causes the counter mechanism to increment/decrement the running count number.

According to at least one embodiment of the present invention, a method is provided that selectively stimulates stages using a single-sized ball. Following the stimulation of a stage, a ball is dropped into the well and pumped down the center of the tubular production string. The ball passes through each downhole tool 126 in the system under the force of the fluid pressure. Because of the diameter of the inner bore of the tubular production string, the ball may pass through a downhole tool 126 only if it decrements a counter. In one embodiment, the counter is a disk that rotates to release the ball. In another embodiment, a button or section of the wall may move in the radial direction to allow the ball to pass and decrement the counter. When the counter reaches zero, a lock is engaged and the counter will no longer allow the ball to pass through the downhole tool 126. With the ball prevented from passing, the flow through the tubular is greatly restricted and a pressure differential will be created. This pressure differential will create sufficient force to move the sleeve from a non-shifted position to a shifted position. The downhole tool may or may not incorporate shear pins to ensure that the sleeve only shifts when a predetermined force is applied. In the shifted position, the ball remains held by the locked counter and provides sufficient flow restriction to divert the bulk of the flow to radial openings in the tubular production string and for the stage to be fraced. Alternatively, the shifting mechanism may activate a flapper device to seal the axial bore of the tubular production string.

While in the non-shifted position, the downhole tool 126 will not allow balls to pass in the reverse direction. However, fluid will be allowed to pass by the ball relatively unimpeded because of the design of the tubular region. This feature allows the completions engineers to flow back in the event of a screen-out, but not accidently flow back beyond the next downhole tool. If this were to happen each ball would then decrement the counter as soon as fracing operations resumed and the sleeves would shift too soon. By preventing the ball from returning while in the downhole tool is in a non-shifted position, counting integrity is preserved. While in the shifted position, the reverse flow lock is removed and the downhole tool will allow relatively unrestricted flow of the balls through the downhole tool 126.

The axial bore of the downhole tool may also allow passage of solid elements, such as wireline tools, tubing, coiled tubing conveyed tools, cementing plugs, balls, darts, and any other elements known in the art. When all of the stages have been fraced, the pressure is reduced and the flow reverses direction. In this flow back mode, the balls will pass back by the counter with very little resistance.

Figure 22:
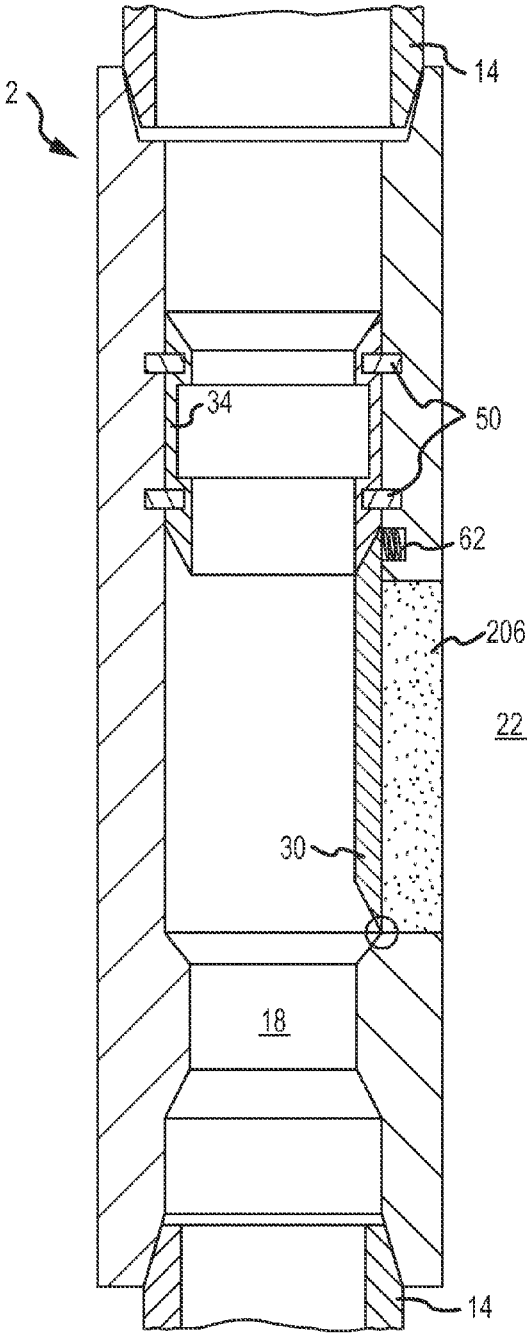
FIG. 22 is a cross-sectional view of a downhole tool that is employed as a whipstock slide according to one embodiment of the present invention.
Figure 23:
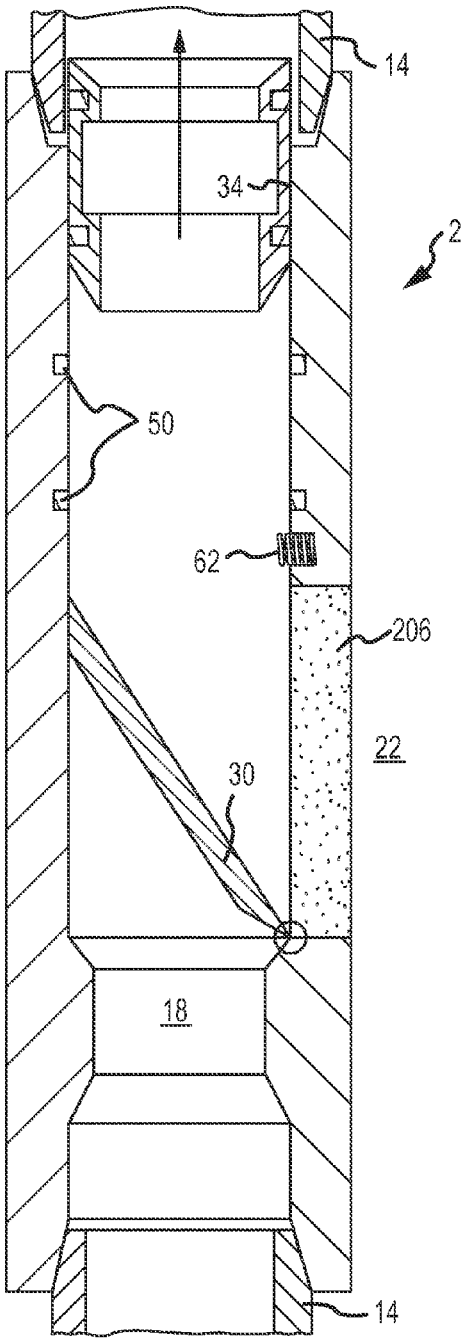
FIG. 23 is another cross-sectional view of the embodiment of FIG. 22.

FIGS. 22-23 illustrate another embodiment wherein the flapper valve 30 is used as a whipstock slide. According to this embodiment, the flapper valve 30 is longer in one axis than in another, such that the flapper valve 30 forms a slide when in the second position. The angled flapper valve 30 assists the placement and extraction of tools through the lateral bore 22 of the downhole tool 2. It is feasible that the lateral bore 22 of the downhole tool 2 may be filled with a fill material 206, such as soft cast iron, cement, etc. that may need to be removed with a drilling apparatus or by chemical treatment. Additionally, an orienting key may be associated with the flapper valve 30 to orient and guide tools to the lateral bore 22 of the downhole tool 2. In some embodiments, the orienting key is a separate member that is landed in a crowsfoot associated with the flapper valve 30. The flapper valve 30 is restrained in its first position by a sleeve 34, which is held in place by shear pins 50. The flapper valve 30 may be held in place by other mechanisms described herein.

Referring to FIG. 23, the sleeve 34 has been displaced vertically within the tubular string 14 by a shifting tool thereby allowing the flapper valve 30 to move from its first position to its second position. The shifting tool may be operated by wireline, slickline, coiled tubing, or jointed pipe as appreciated by one skilled in the art. A hinge 58 interconnects the lower end of the flapper valve 30 to the downhole tool and allows the flapper valve 30 to rotate. A torsion spring 58 biases the flapper valve 30 towards its second position. Another spring 62 may be provided to assist the movement of the flapper valve 30 from its first position to its second position.

FIGS. 24-28 illustrate yet another embodiment wherein a downhole tool 2 is utilized to prevent a well blowout. According to this embodiment, an inner tubular member 210 is operably interconnected to the axial bore of the downhole tool 2 by shear pins 50 or other connecting means known in the art. Additionally, a sealing element 214 may be placed around the inner tubular member 210 to provide a seal between the inner tubular member 210 and the downhole tool 2. The sealing element 214 may be elastomeric, plastic, metallic, or any other sealing elements known to one of ordinary skill in the art. The inner tubular member 210 restricts the movement of the flapper valve 30 and holds the flapper valve 30 in its first position. The upper portion of the inner tubular member 210 forms a chamber that houses a ball 218. The chamber is also defined by a ball seat 222 and a ball cage 226.

Figure 24:
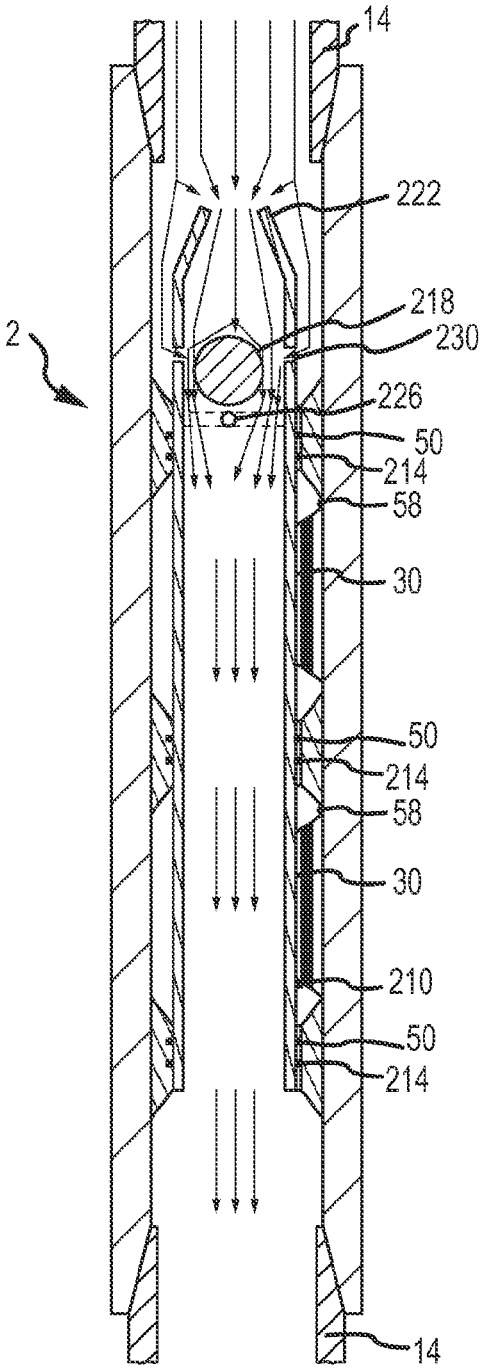
FIG. 24 is a cross-sectional view of a downhole tool that is configured to prevent a well blowout according one embodiment of the present invention.
Figure 25:
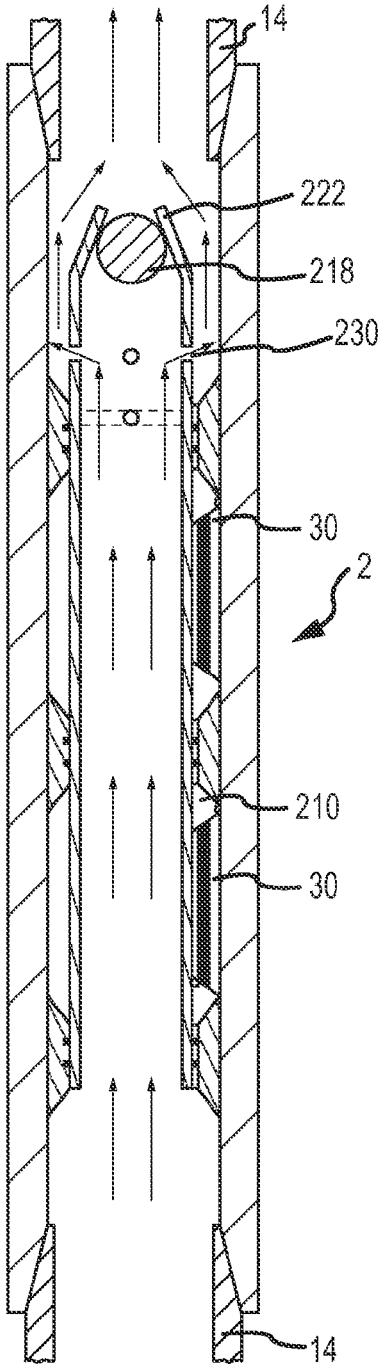
FIG. 25 is another cross-sectional view of the embodiment of FIG. 24.

FIG. 24 shows a condition where fluid is flowing down the tubular string 14. As shown, the fluid flows into the inner bore of the downhole tool 2 and further into the inner tubular member 210 via a ball seat 222 and orifices 230. The fluid flow and pressure forces the ball 218 to contact the ball cage 226, which prevents the ball 218 from moving distally into the tubular string 14. As illustrated, fluid flows around the ball 218 without unduly restricting the fluid flow. In this embodiment, the inner tubular member 210 is held in place within the downhole tool 2 by shear pins 50. The annulus formed between the inner tubular member 210 and the downhole tool 2 is sealed by an o-ring 214 or other sealing elements commonly used in the art. As shown in FIGS. 24-25, three sets of vertically displaced shear pins 50 and o-rings 214 are utilized. As will be appreciated by one of skill in the art, the number of shear pins and sealing elements may vary.

Referring to FIG. 25, as fluid flows up the internal bore of the tubular string 14, it enters the downhole tool 2 and the inner bore of the inner tubular member 210. The fluid flow and pressure causes the ball 218 to seat in the ball seat 222, thus restricting the fluid flow through the inner tubular member 210 by redirecting the fluid flow through orifices 230 in the inner tubular member 210.

Figures 26, 27, 28:
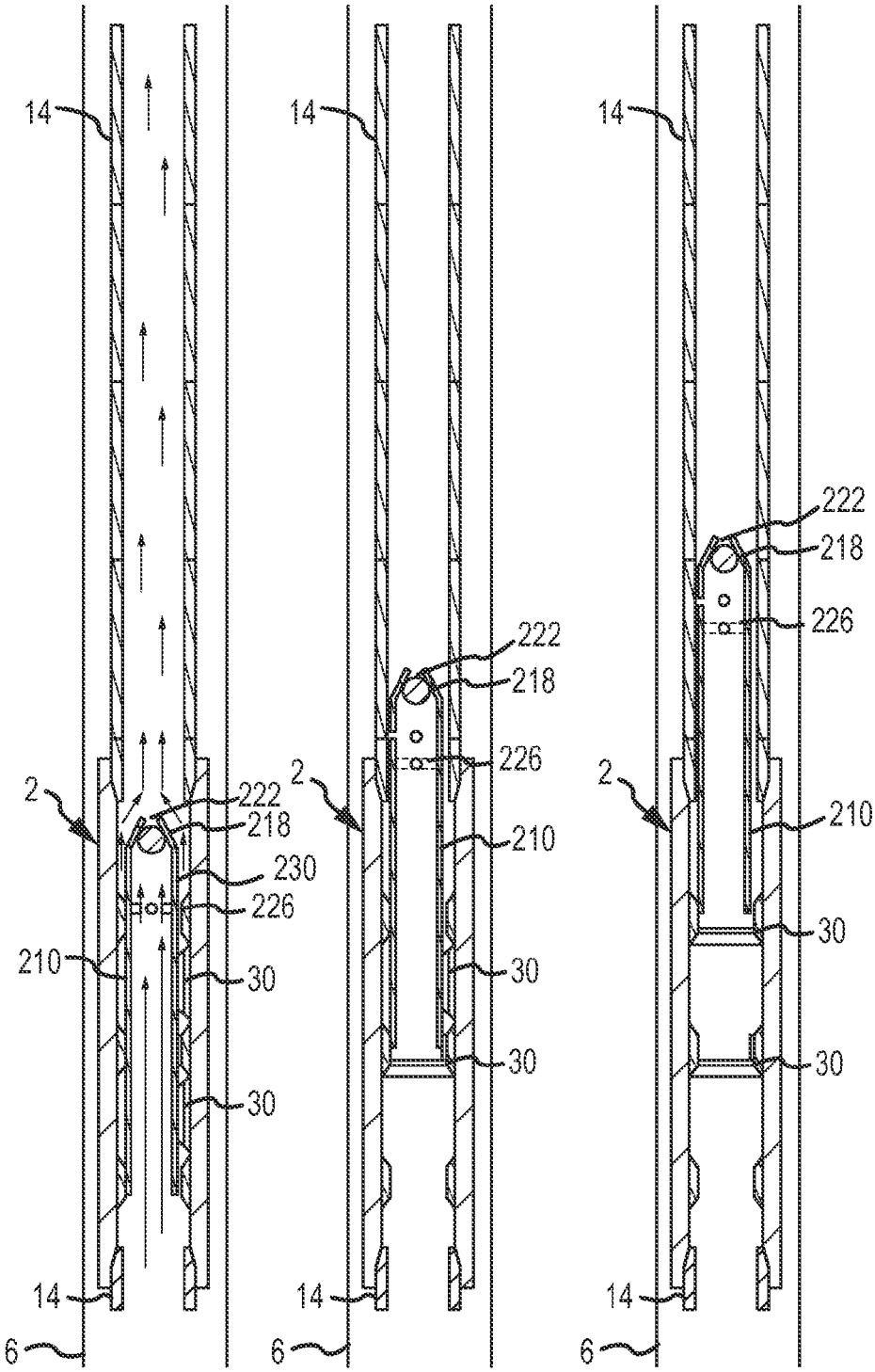
FIG. 26 is yet another cross-sectional view of the embodiment of FIG. 24.
FIG. 27 is a further cross-sectional view of the embodiment of FIG. 24.
FIG. 28 is yet a further cross-sectional view of the embodiment of FIG. 24.

FIG. 26 shows an increased fluid flow associated by a well blowout that is represented by the dark arrows. The increased fluid flow flows through the orifices 230, but in a restricted manner, which creates an upward force on the inner tubular member 210.

In FIG. 27, the increased fluid flow caused by the well blowout has sheared the shear pins 50 and thus the inner tubular member 210 has shifted upward in the downhole tool 2. The upward movement frees the distal flapper valve 30, which allows it to close the axial bore of the downhole tool 2. The momentum of the fluid flow and the inner tubular member 210 causes the inner tubular member 210 to continue moving up the tubular string 14, thus allowing a second proximal flapper valve 30 to close. The flapper valves 30 prevent fluid from flowing up the axial bore of the downhole tool 2, thereby preventing the well blowout. As will be appreciated by one of skill in the art, more or less than two flapper valves 30 may be used without departing from the scope of the invention.

FIGS. 29-32 illustrate a downhole tool 2 actuated by a drop member and catch/release mechanism 250 according to yet another embodiment of the invention. The downhole tool 2 allows access to the annulus of a tubular string placed in a wellbore via a unique valve with two stationary positions with separate bores. One bore of the valve is open to the interior of the tubular to which the valve is attached; the second bore may create a passageway to the annulus of the tubular string by use of a drop member. The inner tubular, when in the initial or first position, has sealing elements (e.g. elastomeric, plastic, metallic) that seal the space between the inner and outer tubular members. The seal allows fluids, such as drilling mud, cement, and fracturing fluids, to be effectively pumped through the bore of the tool with minimal or no leakage to the annulus. The sealing may be enhanced by use of elastomers, O-rings, softer metals or other techniques customary in downhole tools. The tool may also be constructed of metallic or non-metallic materials, such as the composite materials currently used in composite downhole tools. In one embodiment, the tool 2 is connected to the tubular string 14 by a threaded connection.

The downhole tool 2 comprises an inner tubular member 210, outer tubular member 212, catch/release mechanism 250, locking mechanism 260 and locking dog 270. The downhole tool 2 is positioned such that the outer tubular member aligns with fracture ports 26. Inner tubular member 210 is slidable relative to outer tubular member 212. Stated another way, inner tubular member 210 may be actuated relative to outer tubular member 212. The inner tubular member 210 engages with piston 240. As the inner tubular member 210 moves downward, or distally, relative to outer tubular member 212, the piston 240 compresses the spring 90 in communication with the upper reservoir 94 and the lower reservoir 98. The catch/release mechanism 250 comprises collet fingers 252 and is dimensioned with major inner diameter 254 and minor inner diameter 256. The ball 218 moves through axial bore 18 as a result of differential pressure on the upstream and downstream pressure on the back to engage the catch/release mechanism 250.

As will be discussed below, depending on the pressure applied within the axial bore 18, the ball 218 may engage the catch/release mechanism 250 until the catch/release mechanism 260 moves distally, or downwards, within axial bore 18 so as to engage locking mechanism 260, or alternatively, may momentarily engage catch/release mechanism 250 without catch/release mechanism 250 engaging locking mechanism 250. Such alternatives allow the ball 218 to either draw the inner tubular member 210 distally or downward so as to create an opening 26 to axial bore 18, or instead pass through catch/release mechanism 250 without creating such an opening. Thus the internal pressure within the axial bone can be used to selectively open the fracture ports 26 to allow fluid communication to the annulus of the wellbore.

Figure 29A:
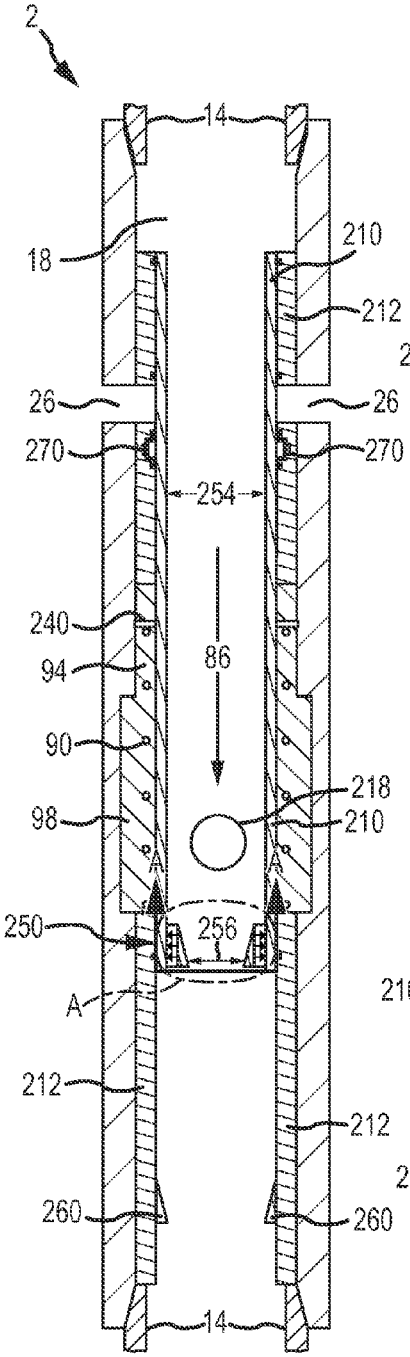
FIG. 29A is a cross-sectional view of a downhole tool in an unactuated state under a low axial bore pressure, the tool actuated by a drop member and catch/release mechanism according to another embodiment of the present invention.
Figure 29B:
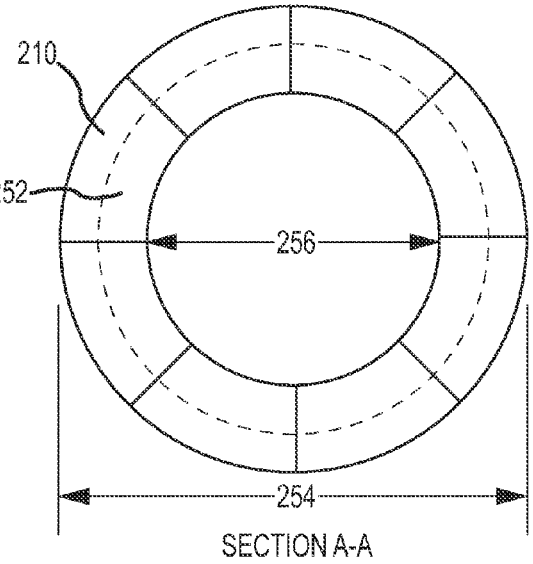
FIG. 29B is a cross-sectional top view of section A-A of the catch/release mechanism of the embodiment of FIG. 29A.
Figure 29C:
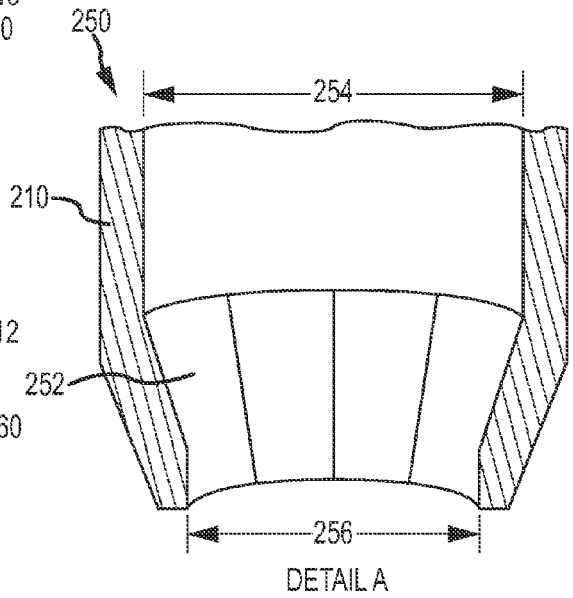
FIG. 29C is a detailed cross-sectional side view of portion A of the catch/release mechanism of the embodiment of FIG. 29A.
Figure 30A:
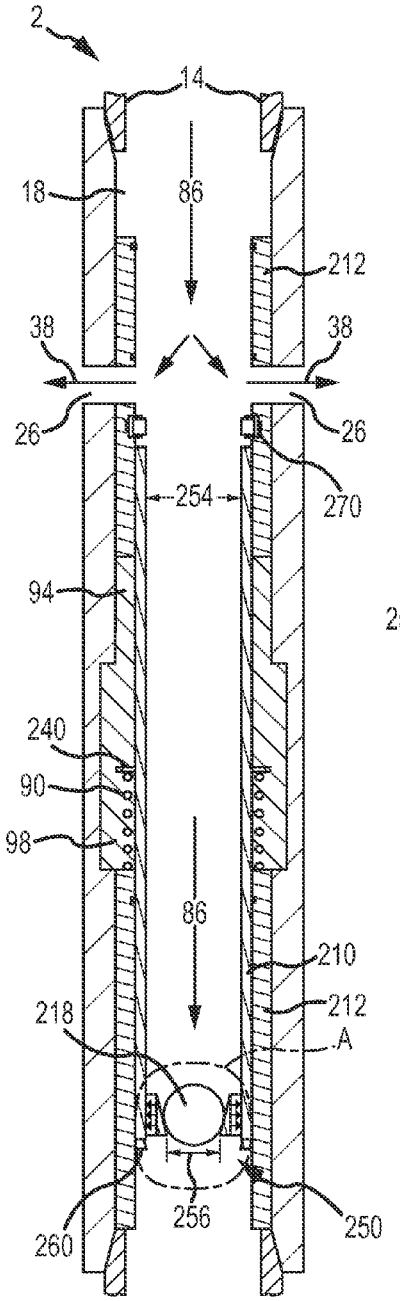
FIG. 30A is a cross-sectional view of the downhole tool shown in FIG. 29A in an actuated state under a low axial bore pressure.
Figure 30B:
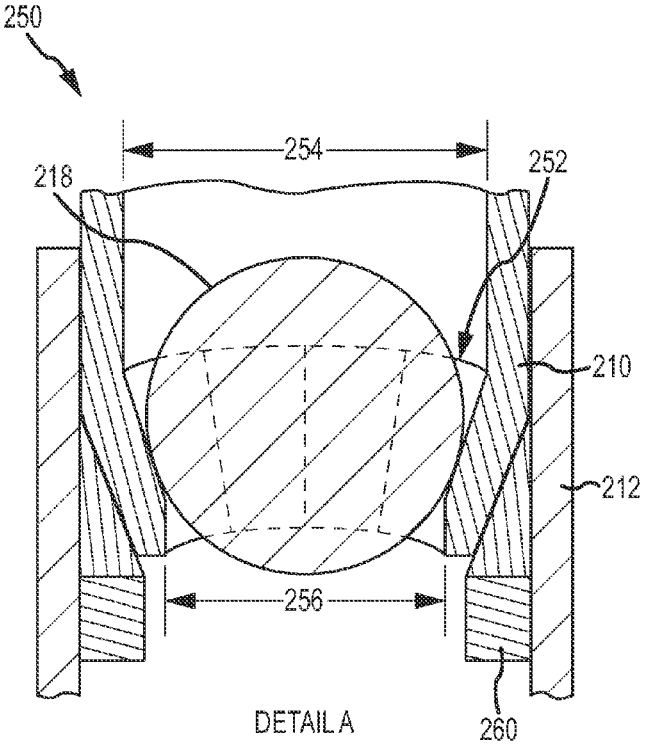
FIG. 30B is a detailed cross-sectional side view of portion A of the downhole tool shown in FIG. 30A.

Referring to FIGS. 29A-C, a downhole tool 2 interconnected to a tubular string 14 within a wellbore is depicted. The downhole tool 2 is shown in an unactuated state under a low axial bore pressure. FIG. 29A is a cross-sectional view of the downhole tool 2, FIG. 29B is a cross-sectional top view of section A-A of the catch/release mechanism 250 of the embodiment of FIG. 29A, and FIG. 29C is a detailed cross-sectional side view of portion A of the catch/release mechanism 250 of the embodiment of FIG. 29A. In the configuration of FIGS. 29A-C, the downhole tool 2 has been positioned in a tubular string 14, a ball 218 pumped into the axial bore 18, with a generally pre-determined lower pressure 86 applied. The drop member ball 14 descends distally within axial bore 18 toward catch/release mechanism 250. The inner tubular member 210 does not appreciably move relative to the outer tubular member 212 and remains in an unactuated state (deemed position one or a first position). As the ball 218 descends within the axial bore 18, the ball 218 engages and lands in the catch/release mechanism 250 at collet fingers 252 and draws both catch/release mechanism 250 downward and inner tubular member 210 downward, until catch/release mechanism 250 engages locking mechanism 260 as depicted in FIGS. 30A-B. The wellbore is thus sealed above the drop member ball 218 from the distal portions of the wellbore. It is important to note that under lower pressure 86, ball 218 engages collet fingers 252 and pulls catch/release mechanism 250 downward, without axially-spreading collet fingers enough to effect passing through collet fingers 252.

When the lower pressure 86 is held in wellbore, it is below that necessary for the drop member ball 218 to disengage from and pass through the tool 2 to travel to any subsequent tool 2 distal from the first tool. The drop member ball 218, when held in the tool at the lower pressure 86, causes the inner tubular member 210 to move from a first position to a second position over a period of time, in a similar manner to the activation cylinder of a hydraulic jar. The activation cylinder, comprising an upper reservoir 94 and lower reservoir 98 of hydraulic oil or similar fluid, bleeds through a fluid communication means, such as a connecting aperture or around the activation cylinder, to allow the cylinder to move over a period of time from the first position to the second position, allowing the inner tubular member 210 to move from the initial (first, unactuated) position to the second (actuated) position.

FIG. 30A is a cross-sectional view of the downhole tool shown in FIG. 29A in an actuated state under a low axial bore pressure and FIG. 30B is a detailed cross-sectional side view of portion A of the downhole tool of FIG. 30A. As depicted in FIGS. 30A-B, the inner tubular member 210 has moved downward or distally so as to create an aperture in tubular string 14 at fracture ports 26, thereby enabling stimulation fluid 38 to flow from axial bore 18 into a hydrocarbon formation adjacent fracture ports 26. That is, the wellbore is open to the annulus of the tool 2. Furthermore, inner tubular member 210 has moved downward or distally so as to activate locking dogs 270, thereby preventing the inner tubular member 210 from moving upwards or proximally up tubular string 14 and closing fracture ports 26. Locking dogs 270 have an unactuated profile within the inner tubular member 210. One example of locking dogs known to those skilled in the art, is provided in U.S. Pat. No. 4,437,522 to Krause, Jr., which is hereby incorporated by reference in its entirety. In this configuration (i.e. when an aperture or flow channel has been created at fracture ports 26 so as to allow stimulation fluid 38 egress from axial bore 18), the inner tubular member 210 is in an actuated state deemed position two or a second position.

Note that the further downward movement of the inner tubular member 210 from the second position, and passing of the drop member ball 218, will be prevented given the change in profile of the stationary portion of the tool 2. That is, the application of a higher pressure within axial bore 18 with the drop ball 218 in place will not cause the drop ball 218 to pass, since the change in profile as provided by the wedge shaped locking mechanism 260 will prevent the radial deformation of the collet fingers 252 and therefore prevent the passing of the drop member ball 218. In fact, a higher pressure will cause the collet fingers 252 with the trapped drop member ball 218 to more tightly wedge into the change in profile. Note that inner diameter 256 of catch/release mechanism 250 is smaller than ball 218 diameter, thus prevents the drop ball 218 from traveling downhole from the wedge shaped locking mechanism 260.

The tool 2 has an internal bore that allows wellbore fluid to be pumped through the tool 2, and also may allow physical passage of solid elements, such as wireline or slickline tools, tubing and coiled tubing conveyed tools, and drop elements, such as cementing plugs, balls and darts, which can pass through the tool when the tool is in the initial closed position. When the tool 2 is in the second (actuated) position, the bore of the tubing is effectively sealed, and fluid pumped into the wellbore is directed to the annulus of the tubular string, through the bore previously closed by the inner tubular member 210. If the device 2 is used with external tubular packers, such as external casing packers, swellable packers or similar devices, it is not anticipated that cement will be on the external portion of the tool. If cement is contemplated to be placed around the tool 2 and hardened, it may be necessary to place an external cover, outside of the tool 2 in the initial position, to prevent the cement from interfering with the movement of the inner tubular member 210 to the second position. Such an external cover would be removed or deformed by the fluid pumped through the second bore. It also may be desired to pump acid or other fluid (including abrasive particle laden fluids) through the opening created by the movement of the inner tubular member 210 to the second position to remove debris and/or the cement from the annulus and improve a fracturing operation.

If the tool 2 is activated with drop members from the surface as described above, it may be desirable to have a multi-pressure activation system. For example if the tool is to be deployed in a horizontal well that is to be fracture stimulated with multiple stages (See FIG. 5), using multiple tools that are connected to and part of the tubular string in the wellbore, it would be desirable to have a tool that would be actuated by an applied first pressure exerted at the surface of the wellbore when the drop member lands and seals in the tool and have a second pressure at which the drop member passes through that tool without actuation, and continues to pass through each tool set distally in the wellbore until the desired tool is reached, and which would be selectively activated to allow a fracture stimulation to be pumped into the annulus of the tubular at a pre-determined location, as described below.

Figure 31A:
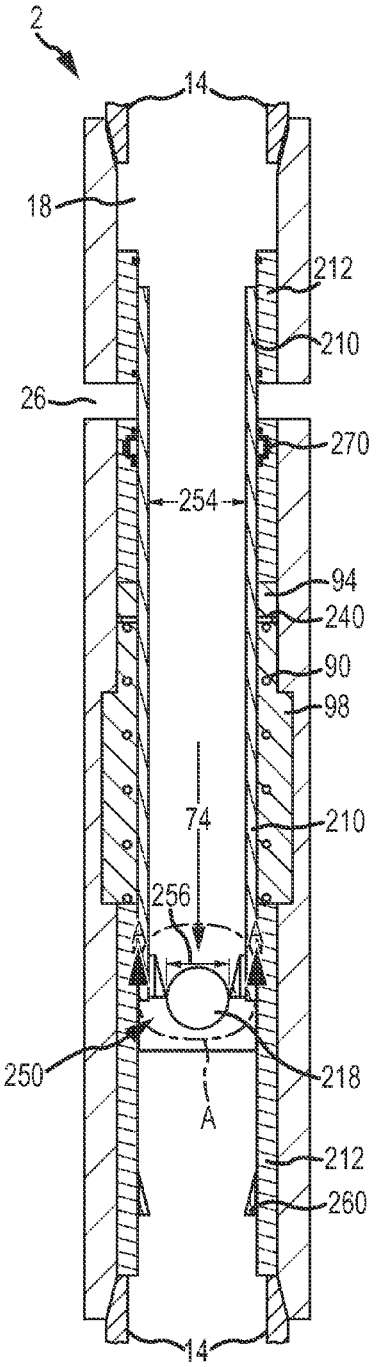
FIG. 31A is a cross-sectional view of the downhole tool shown in FIG. 29A under a high axial bore pressure.
Figure 31B:
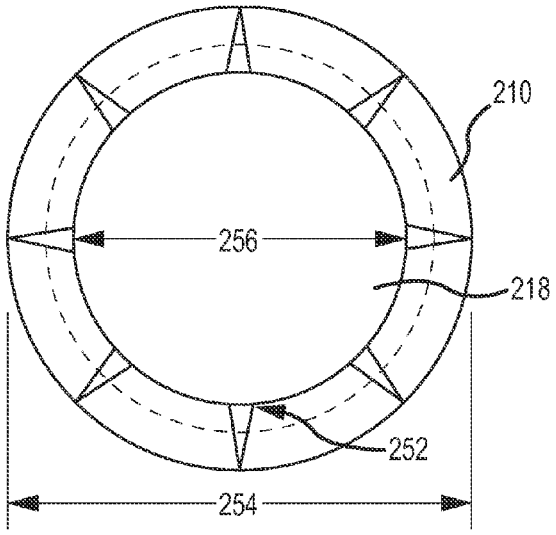
FIG. 31B is a cross-sectional top view of section A-A of the downhole tool shown in FIG. 31A.
Figure 31C:
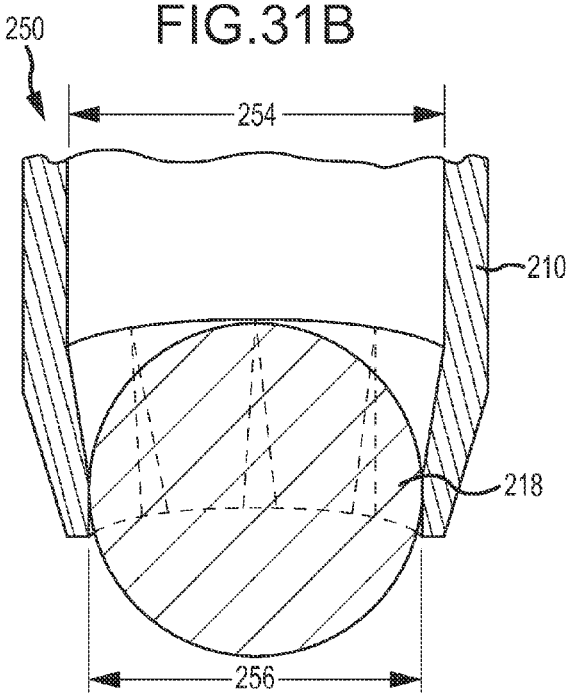
FIG. 31C is a detailed cross-sectional side view of portion A of the downhole tool shown in FIG. 31A.
Figure 31D:
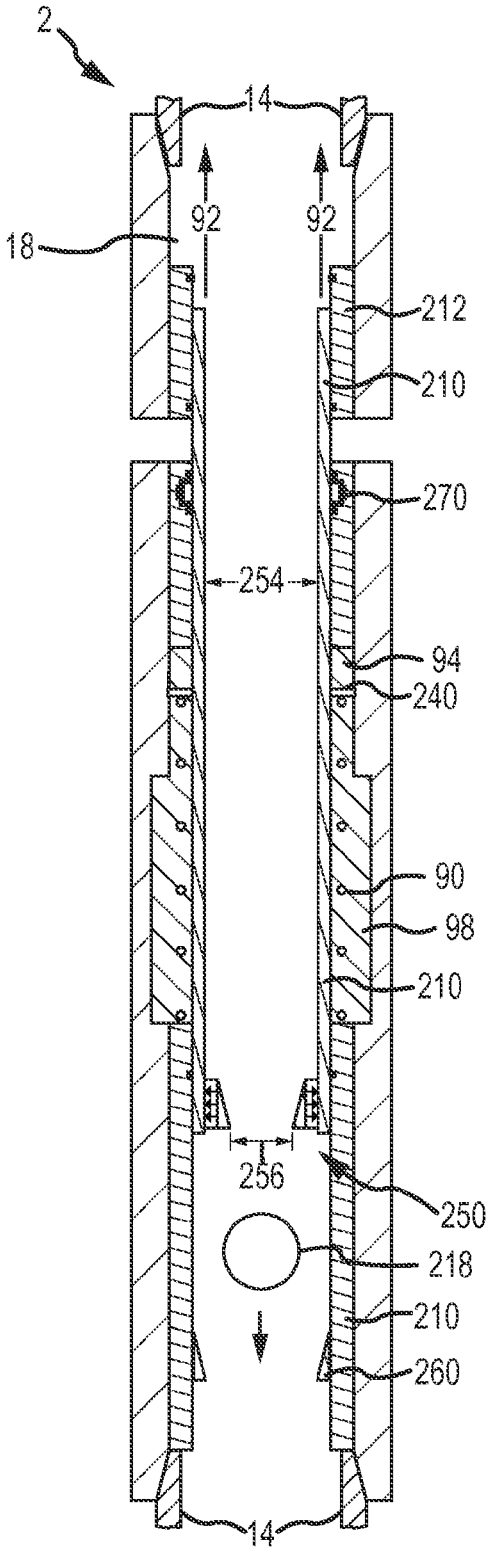
FIG. 31D is a cross-sectional view of the downhole tool shown in FIG. 31A under a high axial bore pressure after passage of the drop member.

When a sufficiently higher pressure 74 (relative to the lower pressure 86 described above) is applied to the downhole tool 2 and a ball 218 inserted into axial bore 18, the downhole tool 2 operates in an alternative manner, as depicted in FIGS. 31A-D. FIG. 31A is a cross-sectional view of the downhole tool shown in FIG. 29A yet under a high axial bore pressure. FIG. 31B is a cross-sectional top view of section A-A of the downhole tool of FIG. 31A, FIG. 31C is a detailed cross-sectional side view of portion A of the downhole tool of FIG. 31A, and FIG. 31D is a cross-sectional view of the downhole tool of FIG. 31A under a high axial bore pressure after passage of the ball drop member.

In the configuration depicted in FIGS. 31A-C, the downhole tool 2 has been positioned in a tubular string 14, a ball 218 inserted into the axial bore 18, and a higher internal wellbore pressure 74 applied. A ball 218 has descended distally within the axial bore 18 toward the catch/release mechanism 250. The inner tubular member 210 has slightly moved relative to the outer tubular member 212, although not enough to open fracture port 26. Under the higher internal wellbore pressure 74, the ball 218 has engaged the catch/release mechanism 250 at collet fingers 252 and slightly drawn both the catch/release mechanism 250 and the inner tubular member 210 downward. However, in contrast to the operation of the downhole tool 2 under the lower pressure 86 operation as discussed above, under the higher internal wellbore pressure 74 the ball 218 engages collet fingers 252 and, while pulling catch/release mechanism 250 downward (and with it inner tubular member 210), the ball 218 axially-spreads collet fingers enough so as to pass through collet fingers 252. FIG. 31C depicts the ball 218 under high pressure 74 as collet fingers 210 spread, such that the inner diameter 256 of the catch/release mechanism 250 is equal to the ball 218 diameter. FIG. 31D depicts downhole tool 2 after ball 218, under high pressure 74, has passed through catch/release mechanism 250. In this state, the inner tubular member 210, as engaged with piston 240 and actuation cylinder, is urged vertically upwards by spring force 92 so as to return to its first (unactuated) state. The actuation cylinder, and thus the inner tubular member 210, is returned to the initial first position by any stored energy device including a spring 90, stored hydraulic energy, etc. Note that a ball 218 which passes through tool 2 as described herein may subsequently travel through tubular string to another tool 2 or to the distal portion of the wellbore as necessary to complete the wellbore operation.

The spring 90 and actuation cylinder also function to prevent premature deployment of the tool 2 resulting from the friction of fluid being pumped through the tool 2 and resulting higher wellbore pressure. Other embodiments employ alternative means to allow controlled passing of a drop ball 218, to include collet slidable devices (e.g. U.S. Pat. Nos. 5,244,044, 4,729,432, 7,373,974, each incorporated by reference in their entirety), collet deformable fingers such as those described above (and also, e.g. U.S. Pat.

Nos. 4,893,678, 4,823,882, 4,292,988, each incorporated by reference in their entirety) and other ball release mechanisms known to those skilled in the art.

In another embodiment, the tool 2 could be configured to allow the return of drop members to the surface by placing an inclined surface on the distal portion of the inner tubular member 210, allowing the drop members to move from tools deployed in the distal portions of the wellbore, back through the tools and returning to the surface. This would be accomplished in a similar manner to the drop members passing tools during stimulation operations, but in the opposite direction. The drop member would contact the inner tubular assembly from the distal end, and push the inner tubular assembly a small distance to engage the locking dogs. This small axial movement will allow the radial deformation of the collet fingers by a buildup of pressure on the drop member from the formations previously stimulated. The drop members could be composed fully or partially of a dissolvable material, such as described in U.S. Patent Appl. Publ. No. 2011/0132621, which is hereby incorporated by reference in its entirety, using nanotechnology, or other materials, such as a magnesium alloy, that will either result in the total dissolution of the drop member or cause a reduction in the ball size to allow the drop members to pass through the tools and back to the wellhead.

Figure 32A:
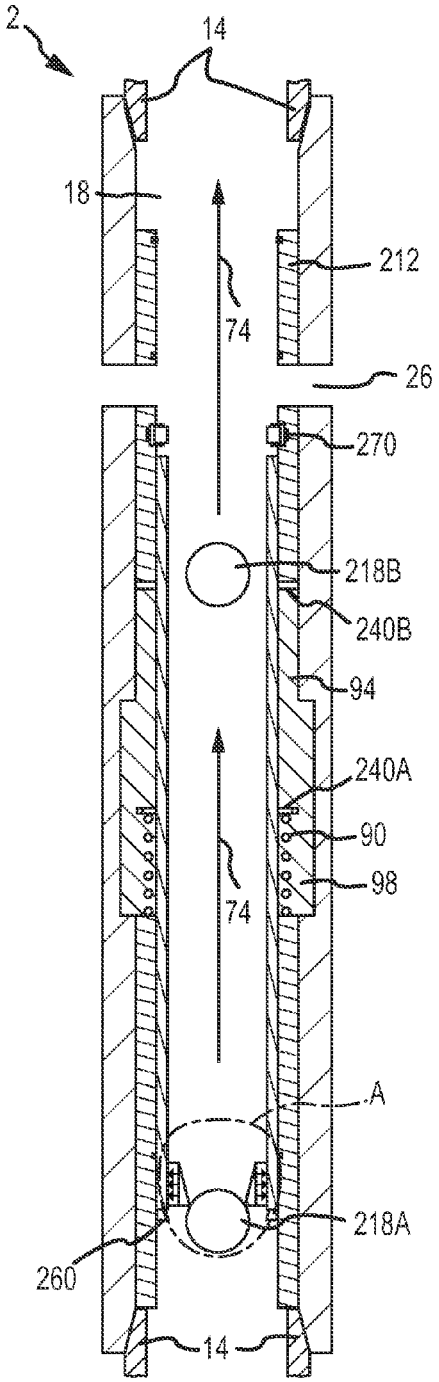
FIG. 32A is a cross-sectional view of a downhole tool in an unactuated state under a high axial bore pressure during retrieval of the drop member.
Figure 32B:
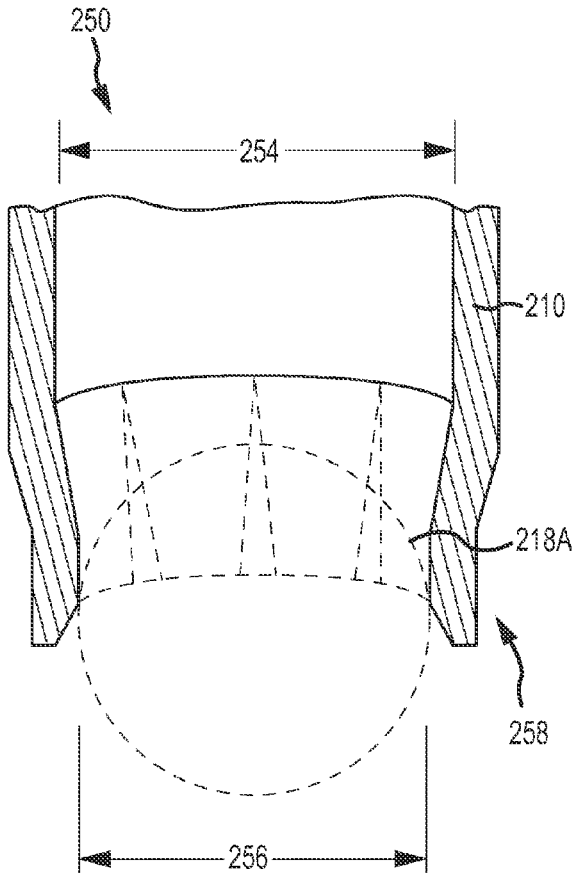
FIG. 32B is a detailed cross-sectional side view of portion A of the downhole tool shown in FIG. 32A.

Once a ball 218 has passed through downhole tool 2 via catch/release mechanism 250, it may be returned as depicted in FIGS. 32A-B. FIG. 32A is a cross-sectional view of a downhole tool in an unactuated state under a high axial bore pressure during retrieval of the drop member, and FIG. 32B is a detailed cross-sectional elevation view of portion A of the downhole tool shown in FIG. 32A. To return ball 218, a high internal wellbore pressure 74 is provided to axial bore 18 such that ball 218 engages the far or distal side of collet fingers 210, as shown by ball position $\mathbf{218}_A$. With enough internal wellbore pressure the ball 218 will spread collet fingers 210 as depicted in FIG. 32B so as to allow passage vertically up the axial bore 18 of the tubing string, as shown by ball 218 at ball position $\mathbf{218}_B$. Note that although ball 218 is returned, inner tubular member 212 remains actuated, as depicted in FIG. 32A, because of extended locking dogs 270. Should the locking dogs 270 be configured for remote actuation or deactuation, the locking dogs 270 could be retracted, in which case inner tubular member 270 would ascend vertically or proximally so as to close fracture ports 26.

In one embodiment, the drop ball 218 is other than substantially round. For example, the drop ball 218 may be oblong spherical, bullet shaped, conical shaped, egg-shaped, or any shape that enables the functions herein described.

Conventional drop members, such as non-metallic frac balls may also have a reduction in size due to the erosive nature of the wellbore fluids being produced through the tool. Even if the frac ball does not open the collet fingers fully to allow the full sized ball to pass and be recovered at the surface, it will cause some radial movement of the fingers, opening a small aperture that will pass wellbore fluid at high velocity. It is well known to one of ordinary skill in the art that small apertures leaking high velocity fluids may quickly become eroded and using a relatively soft non-metallic frac ball will enhance this phenomena to erode the outer diameter of the frac ball, to allow passage through the tool.

Another method to handle the balls during flowback and production would be to extend several of the collet fingers, but not all, so that the balls would be prevented from plugging the tool during production, and that there would be significant flow area around the ball through the spaces of the collet fingers that were not extended, such that all production would bypass the ball and not cause a production shortfall due to plugging of the tools by the balls during flowback and production. Another means to return a ball include the use of a ball with a dissolvable outer layer which dissolves over time to create a smaller diameter ball which may pass through a catch/release mechanism.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that modifications and alterations are within the scope and spirit of the present invention, as set forth in the following claims.

What is claimed is:

1. A downhole tool adapted for use in a tubular string to selectively treat one or more hydrocarbon production zones, comprising:

an upper end and a lower end adapted for interconnection to the tubular string;

a catch mechanism positioned proximate to said lower end and adapted to selectively catch or release a ball traveling through said tubular string;

a sleeve which travels in a longitudinal direction between a first position and a second position, and which is actuated based on an internal pressure in said tubular string, said sleeve preventing a flow of a treatment fluid in a lateral direction into an annulus of a wellbore while in said first position, and permitting the flow of said treatment fluid in the lateral direction through at least one port in said second position;

a flange interconnected to the sleeve and comprising a weep hole, the weep hole configured to allow fluid flow to either an upper fluid reservoir and a lower fluid reservoir, wherein the lower fluid reservoir has a greater diameter than the upper fluid reservoir, said weep hole further configured to travel between a first position adjacent the upper fluid reservoir and a second position adjacent the lower fluid reservoir, wherein said sleeve travels at an increased rate when the flange is positioned adjacent the lower fluid reservoir: and a locking mechanism positioned proximate to said catch mechanism, wherein when said catch mechanism is engaged with said locking mechanism, said sleeve is in said second position and said treatment fluid cannot be pumped downstream of said catch mechanism in said tubular string.

2. The downhole tool of claim 1, wherein said catch mechanism comprises a collet assembly which allows said ball to pass if said pressure in said tubular string is above a predetermined level.

3. The downhole tool of claim 2, wherein said collet assembly comprises a plurality of extensions forming a first diameter at a proximal end and a second diameter at a distal end, said first diameter greater than said second diameter.

4. The downhole tool of claim 3, wherein said second diameter is configured to expand to an increased diameter slightly greater than or equal to a diameter of said ball based on said internal pressure in said tubular string, wherein said ball passes said catch mechanism.

5. The downhole tool of claim 1, further comprising an actuator mechanism adjacent to said sleeve adapted to urge said sleeve from said second position to said first position.

6. The downhole tool of claim 1, wherein said ball is comprised of a degradable material which disintegrates over a predetermined period of time.

7. The downhole tool of claim 1, further comprising a latch mechanism which retains said sleeve in said second position which allows the substantially unrestricted flow of fluid through said tubular string during the production of fluids from said hydrocarbon production zones.

8. The downhole tool of claim 1, wherein said sleeve is actuated between said first position and said second position by maintaining said pressure for a predetermined period of time.

9. A downhole tool adapted for use in a tubular string to selectively treat one or more hydrocarbon production zones, comprising:

an upper end and a lower end adapted for interconnection to a tubular string;

a catch mechanism positioned proximate to said lower end and adapted to selectively catch or release a ball traveling through said tubular string;

a sleeve which travels in a longitudinal direction between a first position and a second position, and which is actuated based on an internal pressure in said tubular string, said sleeve preventing a flow of a treatment fluid in a lateral direction into an annulus of said wellbore while in said first position, and permitting the flow of said treatment fluid in the lateral direction through at least one port in said second position;

a flange interconnected to the sleeve and comprising a weep hole, the weep hole configured to allow fluid flow to either an upper fluid reservoir and a lower fluid reservoir, wherein the lower fluid reservoir has a greater diameter than the upper fluid reservoir, and further wherein said sleeve travels at an increased rate when the flange is positioned adjacent the lower fluid reservoir; and a locking mechanism positioned proximate to said catch mechanism, wherein when said catch mechanism is engaged with said locking mechanism, said sleeve is in said second position and said treatment fluid cannot be pumped downstream of said catch mechanism in said tubular string.

10. A method for treating a plurality of hydrocarbon production zones at different locations in one or more geologic formations, comprising:

providing a wellbore with an upper end, a lower end and a plurality of producing hydrocarbon zones positioned therebetween;

positioning a string of production tubing in the wellbore, said string of production tubing having an upper end and a lower end;

providing a plurality of selective opening tools in said production string, each of said selective opening tools having: a catch mechanism adapted to selectively catch or release a ball traveling through said production string; a sleeve which travels in a longitudinal direction between a first position and a second position and which is actuated based on an internal pressure in said production string, said sleeve preventing a flow of a treatment fluid in a lateral direction into an annulus of the wellbore while in said first position, and permitting the flow of the treatment fluid in the lateral direction through at least one port in said second position; a flange interconnected to the sleeve and comprising a weep hole, the weep hole configured to allow fluid flow to either an upper fluid reservoir and a lower fluid reservoir, wherein the lower fluid reservoir has a greater diameter than the upper fluid reservoir, and further wherein said sleeve travels at an increased rate when the flange is positioned adjacent the lower fluid reservoir; and a locking mechanism positioned proximate to said catch mechanism, wherein when said catch mechanism is engaged with said locking mechanism, said sleeve is in said second position and said treatment fluid cannot be pumped downstream of said catch mechanism in said production string;

pumping a treatment fluid containing a ball through the production string at a predetermined first pressure until said ball engages a catch mechanism of a first selective opening tool positioned proximate to a first of said plurality of producing hydrocarbon zones;

maintaining said first pressure in said production string for a pre-determined period of time to displace said catch mechanism of said first tool and engage a locking mechanism of said first tool, wherein a sleeve of said first tool is in a second position;

pumping the treatment fluid into said first producing hydrocarbon zone;

reducing the pressure in said production string, wherein said catch mechanism of said first tool disengages from said locking mechanism and said sleeve returns to a first position;

pumping the treatment fluid at a predetermined second pressure until said ball engages and passes through said catch mechanism of said first selective opening tool, said second pressure higher than said first pressure;

reducing the treatment fluid pressure to said first pressure to position said ball in a catch mechanism of a second selective opening tool positioned proximate to a second of said plurality of producing hydrocarbon zones, wherein said catch mechanism engages a locking mechanism of said second tool, and wherein a sleeve of said second tool is in a second position; and pumping the treatment fluid into said second producing hydrocarbon zone.

11. The method of claim 10, wherein said treatment fluid comprises at least one of an acid, a proppant material, and a gel.

12. The method of claim 10, wherein said catch mechanism comprises a collet assembly which allows said ball to pass if the pressure in said production string is above a predetermined level.

13. The method of claim 12, wherein said collet assembly comprises a plurality of extensions forming a first diameter at a proximal end and a second diameter at a distal end, said first diameter greater than said second diameter, wherein said second diameter is configured to expand to an increased diameter approximately equal to a diameter of said ball based on said internal pressure in said production string, wherein said ball passes said catch mechanism.

14. The method of claim 10, further comprising an actuator mechanism adjacent to said sleeve adapted to urge said sleeve from said second position to said first position.

15. The method of claim 10, wherein said ball is comprised of a degradable material which disintegrates over a predetermined period of time.

16. A system adapted for use in a tubular string for treating one or more hydrocarbon production zones, comprising:

a plurality of downhole tools, each comprising:

a) an upper end and a lower end adapted for interconnection to said tubular string;

b) a catch mechanism positioned proximate to said lower end and adapted to selectively catch or release a ball traveling through said tubular string;

c) a sleeve which travels in a longitudinal direction between a first position and a second position, and which is actuated based on an internal pressure in the tubular string, said sleeve preventing a flow of a treatment fluid in a lateral direction into an annulus of a the wellbore while in said first position, and permitting the flow of the treatment fluid in the lateral direction through at least one port in said second position; and d) a flange interconnected to said sleeve and comprising a weep hole, said weep hole configured to allow fluid flow to either an upper fluid reservoir and a lower fluid reservoir, wherein the lower fluid reservoir has a greater diameter than the upper fluid reservoir, and further wherein said sleeve travels at an increased rate when said flange is positioned adjacent the lower fluid reservoir;

e) a locking mechanism positioned distal to said catch mechanism, wherein when said catch mechanism is engaged with said locking mechanism, said sleeve is in said second position and the treatment fluid cannot be pumped downstream of said catch mechanism in said tubular string;

wherein when a treatment fluid containing said ball is pumped into said tubular string at a predetermined first pressure, said ball displaces a catch mechanism of a first of said plurality of downhole tools until engaging a locking mechanism of said first tool, wherein a sleeve of said first tool is in a second position; and wherein when a treatment fluid containing a ball is pumped into said tubular string at a predetermined second pressure greater than said first pressure, said ball passes through said catch mechanism of said first tool until engaging a catch mechanism of a second downhole tool.

17. The system of claim 16, wherein said catch mechanism comprises a collet assembly which allows the ball to pass if the pressure in said tubular string is above a predetermined level.

18. The system of claim 17, wherein said collet assembly comprises a plurality of extensions forming a first diameter at a proximal end and a second diameter at a distal end, said first diameter greater than said second diameter, wherein said second diameter is configured to expand to an increased diameter approximately equal to or greater than a diameter of said ball based on said internal pressure in said tubular string, wherein said ball passes said catch mechanism and travels down said tubular string.

19. The system of claim 16, further comprising an actuator mechanism adjacent to said sleeve adapted to urge said sleeve from said second position to said first position.

20. The system of claim 16, wherein said ball is comprised of a degradable material which disintegrates over a predetermined period of time.

* * * * *